US006446563B1

(12) United States Patent
Ohanesian

(10) Patent No.: US 6,446,563 B1
(45) Date of Patent: Sep. 10, 2002

(54) THERMOPLASTIC PALLET

(76) Inventor: Harout Ohanesian, 9 Tattersail La., Laguna Niguel, CA (US) 92677

( * ) Notice: Subject to any disclaimer, the term of this patent is extended or adjusted under 35 U.S.C. 154(b) by 0 days.

(21) Appl. No.: 09/514,518

(22) Filed: Feb. 28, 2000

Related U.S. Application Data

(63) Continuation-in-part of application No. 09/168,304, filed on Oct. 7, 1998.

(51) Int. Cl.[7] ..... B65D 19/38

(52) U.S. Cl. ..... 108/57.25; 108/902; 108/56.3; 108/53.3

(58) Field of Search ..... 108/56.1, 56.3, 108/53.1, 53.3, 57.18, 57.19, 57.25, 57.28, 57.29, 57.33, 901, 902

(56) References Cited

U.S. PATENT DOCUMENTS

| | | | | | |
|---|---|---|---|---|---|
| 3,467,032 | A | | 9/1969 | Rowlands et al. | |
| 3,524,415 | A | | 8/1970 | Heiman | |
| 3,610,173 | A | | 10/1971 | McIlwraith et al. | |
| 3,695,188 | A | * | 10/1972 | Granatstein | 108/57.28 |
| 3,699,901 | A | * | 10/1972 | Cook, III | 108/57.25 |
| 3,702,100 | A | * | 11/1972 | Wharton | 108/53.3 |
| 3,707,127 | A | | 12/1972 | Palfey | |
| 3,719,157 | A | | 3/1973 | Arcocha et al. | |
| 3,750,596 | A | | 8/1973 | Box | |
| 3,776,145 | A | | 12/1973 | Anderson et al. | |
| 4,000,704 | A | * | 1/1977 | Griffin, Jr. | 108/53.3 X |
| 4,015,544 | A | | 4/1977 | Szatkowski | |
| 4,240,360 | A | * | 12/1980 | Sanders et al. | 108/53.3 |
| 4,290,369 | A | | 9/1981 | Propst et al. | |
| 4,428,306 | A | | 1/1984 | Dresen et al. | |
| 4,674,414 | A | * | 6/1987 | Nulle et al. | 108/53.3 |
| 5,117,762 | A | * | 6/1992 | Shuert | 108/57.25 |
| 5,197,396 | A | | 3/1993 | Breezer et al. | |
| 5,579,686 | A | | 12/1996 | Pigott et al. | |
| 5,791,261 | A | * | 8/1998 | John et al. | 108/57.33 X |
| 6,029,583 | A | * | 2/2000 | LeTrudet | 108/57.25 |

* cited by examiner

*Primary Examiner*—Peter M. Cuomo
*Assistant Examiner*—Hanh V. Tran
(74) *Attorney, Agent, or Firm*—Vic Y. Lin; Joseph C. Andras; Myers, Dawes & Andras LLP

(57) ABSTRACT

An improved load bearing pallet includes an upper deck formed from a sheet of thermoplastic material with a load engaging surface and an opposing, substantially parallel lift engaging surface. Ridges, channels, depressions, and legs, are formed in the sheet with corresponding features being necessarily defined by the sheet on the opposite side. The pallet preferably includes a peripheral channel formed around a periphery of the upper deck and nine legs positioned in three rows of three creating two gaps on each side of the pallet for the tines of a fork lift to enter to lift the pallet. A plurality of strengthening ridges and channels are formed in the load bearing surface of the upper deck, with corresponding channels and ridges necessarily formed in the lifting surface of the upper deck, to resist bending and folding of the pallet. A reinforcing member received within the peripheral channel includes a steel core encapsulated within a thermoplastic coating that is molecularly bonded or cross-linked to the molecular structure of the thermoplastic material of the pallet. A lower deck or other support structure may be coupled or molecularly bonded to the upper deck. The lower deck may also include ridges, channels, depressions, legs, and reinforcing members. The pallet includes runners coupled to the legs of the decks, a stack of decks with runners, and a method for stacking decks when the decks are not in use. The pallet further includes modular dual deck pallets to allow ease of transportation and storage.

14 Claims, 20 Drawing Sheets

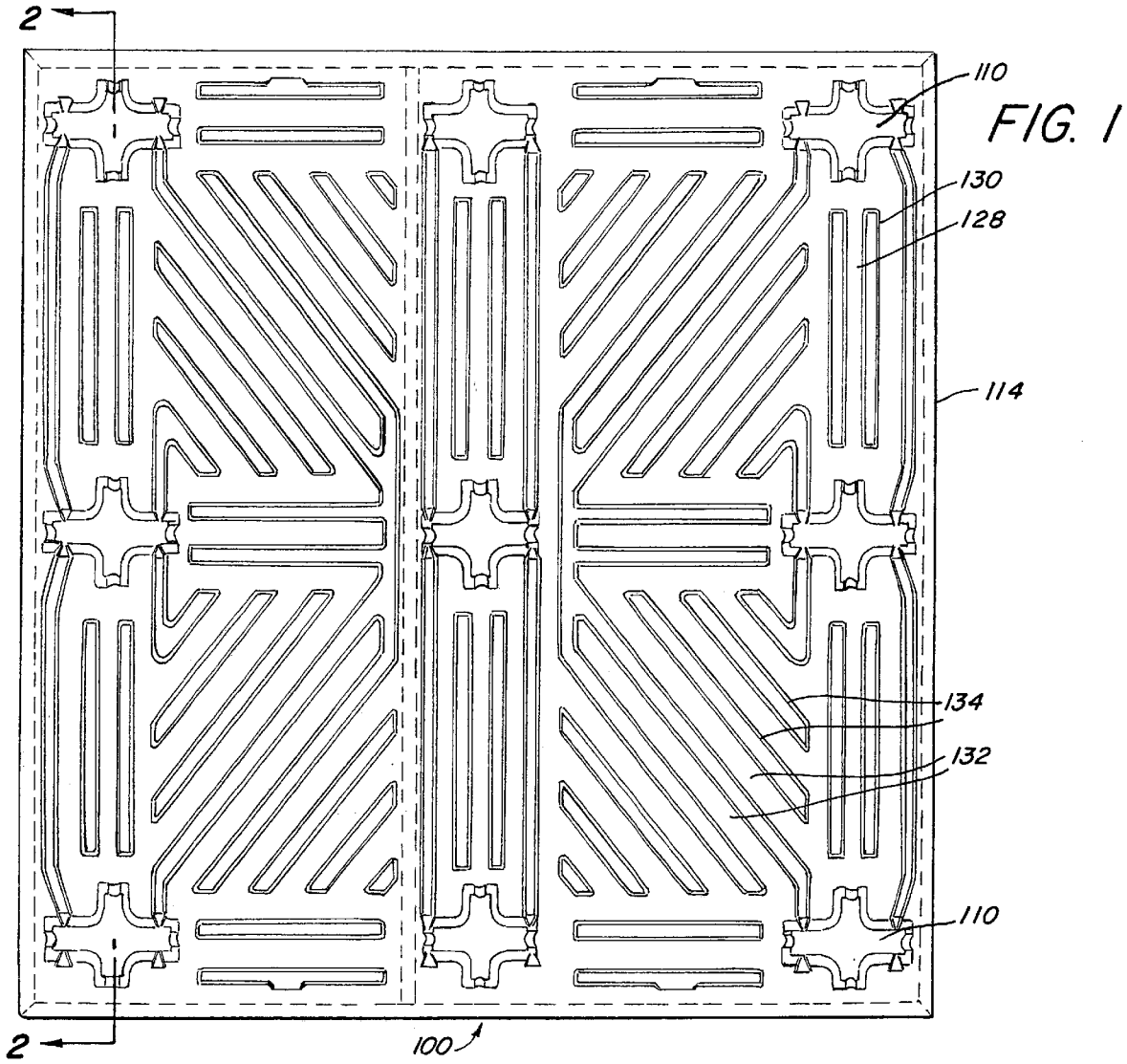
FIG. 1
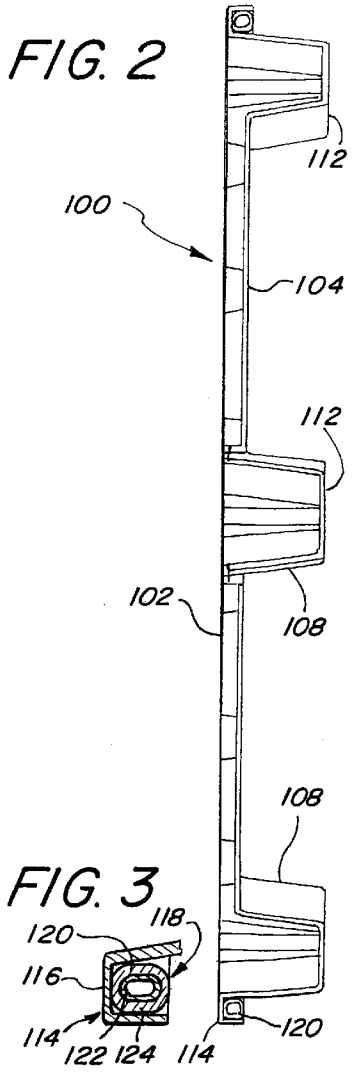
FIG. 2
FIG. 3

THERMOPLASTIC PALLET

Related Application

This application is a continuation-in-part of application Ser. No. 09/168,304 filed on Oct. 7, 1998.

BACKGROUND OF THE INVENTION

1. Field of the Invention

The present invention relates generally to pallets and shipping trays, and more particularly to improved load bearing pallets and shipping trays comprising thermoplastic material.

2. Description of Related Art

Many wooden and plastic pallets are known in the art. However, pre-existing wooden and plastic pallets are characterized by a number of disadvantages. Wooden pallets are relatively heavy and difficult to manufacture. Typical construction of such pallets utilize a first set of parallel boards forming an upper surface, and a second set of parallel boards forming a lower surface, nailed to three or more stringers positioned perpendicular to the length of the boards, and sandwiched between the upper and lower surfaces. The stringers used to separate the upper and lower deck surfaces create two openings to accommodate the arms of a forklift for lifting and moving the pallets. The wood used to construct the pallets may swell and warp if exposed to moisture. Wooden pallets are subject to rotting and splintering, and the wood may be a substrate for the growth of fungus and bacteria, especially under moist conditions. The nails used in the pallets may rust, and sometimes causes cargo damage or injuries.

Attempts to form pallets from other materials in order to avoid the disadvantages inherent in wooden pallets have been only partially successful. Prior art designs using plastics to form pallets have been characterized by a trade off between cost and weight bearing capability. Those pallets having a significant weight bearing capability tend to be heavy and expensive, whereas plastic pallets produced inexpensively typically have reduced durability and weight bearing capacity.

What is needed is a pallet design comprising a plastic material that overcomes the disadvantages of the prior art. Specifically, it is desirable to provide a pallet that is inexpensive and relatively light weight yet strong, that is formed of recyclable materials, that is stackable, that may be readily assembled on site, that may be picked up by a fork lift from all four sides, that is resistant to the growth of fungus and bacteria, and that is easily cleaned.

SUMMARY OF THE INVENTION

Accordingly, the invention is an improved load bearing pallet including at least an upper deck formed of a sheet of rigid but formable material, such as plastic or metal but preferably a thermoplastic material, with a load engaging surface on one side of the sheet and a lift engaging surface on the other. A number of features such as ridges, channels, depressions, and legs are formed in the sheet with corresponding features being defined by the sheet on the opposite side. The pallet preferably includes a peripheral channel formed around a periphery of the upper deck and nine legs positioned in three rows of three creating two gaps on each side of the pallet for the tines of a fork lift to enter to lift the pallet.

In a second embodiment, the pallet may further include at least one integral reinforcing member received within the peripheral channel. Preferably one reinforcing member is positioned within the peripheral channel on each side of the pallet, but in alternate embodiments, a unitary ring that fits around the pallet, but within the peripheral channel, may be used. The reinforcing members may be formed of any desired materials, including metal or wood. However, the reinforcing members preferably comprise a steel support structure encapsulated within a thermoplastic material. The reinforcing members are preferably bonded within the channel of the upper deck by causing the molecular structure of the thermoplastic material encapsulating the support structure to cross-link with the thermoplastic material comprising the upper deck to integrally bond the reinforcing member to the upper deck to form a unitary object.

In other embodiments, the pallet may further include a lower deck or other support structure. The lower deck is preferably formed of a single sheet of rigid but formable material, preferably a thermoplastic material, comprising a top surface and a bottom surface. A plurality of legs are formed in the top surface of the lower deck, corresponding to an equal number of legs extending from the lifting surface of the upper deck. Each leg formed in this way in the lower deck is coupled to a corresponding leg of the upper deck. The bond between the legs of the lower deck and the legs of the upper deck are preferably made by causing the molecular structure of the thermoplastic material of the upper deck to cross link to the molecular structure of the lower deck, although in alternate embodiments, other means for coupling the upper and lower decks may be used.

The lower deck may further include a plurality of channels and ridges formed in the top surface of the lower deck, which correspond to channels and ridges formed in the bottom surface. The lower deck may additionally include a plurality of reinforcing members, each preferably comprising a steel support structure encapsulated within a thermoplastic coating, although other materials may be used in alternate embodiments. The reinforcing member is received within the peripheral channel of the lower deck and is preferably bonded therein by causing the molecular structure of the thermoplastic material encapsulating the support structure to cross link with the molecular structure of the thermoplastic material of the lower deck.

The invention further includes a single deck pallet with runners. Such a pallet comprises a single sheet comprising a rigid but formable material, a load bearing surface on a first side of the sheet, and a lifting surface on an opposite second side of the sheet. A plurality of depressions are formed in the load bearing surface corresponding to an equal number of legs extending from the lifting surface. A runner is coupled to at least two of the legs. The lifting surface is substantially parallel to the load bearing surface such that features defined in the load bearing surface will have a corresponding feature defined in the lifting surface. Thus, a plurality of top channels and top ridges are formed in the load bearing surface wherein each top ridge formed in the load bearing surface corresponds to a bottom channel formed in the lifting surface and each top channel formed in the load bearing surface corresponds to a bottom ridge formed in the lifting surface.

The single sheet has four edges defining a periphery. A peripheral channel is formed adjacent to the periphery of the sheet. The rigid but formable material of the sheet comprises a thermoplastic material. The runner is coupled to one of the rows of three legs. The plurality of depressions comprises nine depressions corresponding to nine legs, the nine depressions and legs being disposed in three rows with each row having three depressions and three corresponding legs. The runner has a substantially flat upper and lower surface. The runner comprises wood or any other solid material. The runner comprises a thermoplastic covering.

At least two of the legs which are coupled to the runner each comprise a recessed portion and an exposed portion. The runner may have a flat bottom runner surface as well as a flat top runner surface. The runner is disposed in the recessed portions of the at least two of legs such that the bottom runner surface is substantially flush with the exposed portions of the at least two legs. Furthermore, the runner may be removably coupled to at least two of the legs with a locking pin or any other securing mechanism.

The invention further comprises a pallet made of two sheets, or a dual deck pallet. A first sheet, or upper deck, is coupled to a second sheet, or lower deck, to form the single pallet. The second sheet may have a structure that is substantially similar to or different from a structure of the first sheet. If the sheets are identical or substantially similar in structure, the first sheet may be nested on top of the second sheet when the pallet is disassembled and not in use. If the sheets are different in structure, the pallet may be disassembled and the first sheet may be nested on top of a first sheet of another pallet while the second sheet may be nested on top of a second sheet of the other pallet.

The first sheet comprises a first rigid but formable material. The first sheet has a first structure including a first external surface, a first internal surface substantially parallel and opposite to the first external surface, and a first plurality of channels and ridges. The first plurality of channels and ridges formed in the first sheet result in a plurality of channels and ridges in the first external surface and a corresponding plurality of ridges and channels in the first internal surface. Since the first internal surface is substantially parallel to the first external surface, each ridge formed in the first external surface corresponds to a channel formed in the first internal surface, and each channel formed in the first external surface corresponds to a ridge formed in the first internal surface.

The second sheet comprises a second rigid but formable material, which may be similar to or different from the first rigid but formable material. The second sheet has a second structure which may be different from or substantially similar to the first structure. The second structure includes a second external surface, a second internal surface substantially parallel and opposite to the second external surface, and a second plurality of outer channels and outer ridges. The second plurality of channels and ridges formed in the second sheet result in a plurality of channels and ridges in the second external surface and a corresponding plurality of ridges and channels in the second internal surface. Since the second internal surface is substantially parallel to the second external surface, each ridge formed in the second external surface corresponds to a channel formed in the second internal surface and each channel formed in the second external surface corresponds to a ridge formed in the second internal surface formed in the second external surface wherein each ridge in the second external surface corresponds to a channel formed in the second internal surface and each channel formed in the second external surface corresponds to a ridge formed in the second internal surface.

The first and second rigid but formable material comprises a thermoplastic material. The first and second sheet each comprise a peripheral channel formed adjacent to a periphery of each sheet.

The pallet may include a first reinforcing member received within the peripheral channel of the first sheet. The first reinforcing member comprises a structural member encapsulated within a thermoplastic material. In addition, the pallet may also include a second reinforcing member received within the peripheral channel of the second sheet. The second reinforcing member comprises a structural member encapsulated within a thermoplastic material. Furthermore, each sheet may include additional reinforcing members. When the second sheet is different in structure from the first sheet, the first reinforcing member has an oval profile with a first height while the second reinforcing member has a square profile with a second height that is less than the first height.

In the dual deck pallet, the first internal surface and the second internal surface face each other. Accordingly, the first external surface and the second external surface face outwardly away from each other. The pallet further comprises a plurality of columns disposed between and coupled to the first sheet and the second sheet. The columns each comprise a bottom portion, a top portion, and a tube extending from the bottom portion to the top portion. The pallet further comprises a plurality of clamping pins, wherein a clamping pin is disposed in the tube of each of the at least four columns.

The first sheet has a first plurality of apertures. The second sheet has a second plurality of apertures. Each clamping pin extends through an aperture of the first sheet and an aperture of the second sheet. Each clamping pin has a hollow core. Each clamping pin comprises a first lip at a first end and a second lip at a second end, wherein the first lip has a first diameter greater than a diameter of the apertures of the first sheet, and wherein the second lip has a second diameter greater than a diameter of the apertures of the second sheet. The first sheet may comprise a first plurality of shoulders, wherein a shoulder surrounds each aperture. The second sheet comprises a second plurality of shoulders, wherein a shoulder surrounds each aperture. The lip at the first end of each clamping pin rests against the shoulder surrounding a corresponding aperture of the first sheet. The lip at the second end of each clamping pin rests against the shoulder surrounding a corresponding aperture of the second sheet. A rigid washer is disposed between the lips of the clamping pin and the shoulder of the corresponding aperture on the sheet. The washer serves to spread the compressional load from the lips of the clamping pin onto a wider area of the sheet to provide a stronger connection.

The dual deck pallet further comprises a plurality of rigid inserts, wherein a rigid insert is disposed in a top portion and a bottom portion of the hollow core of each clamping pin. Each rigid insert comprises a recess. The dual deck pallet further comprises a plurality of anti-skid plugs, wherein a plug is disposed in each recess of each rigid insert.

In one aspect, the second sheet may have a structure different from a structure of the first sheet. The second sheet, or lower deck, may include less material in its composition. Thus, the second sheet may include a plurality of large, central openings, or gaps. The second sheet may also have a height less than a height of the first sheet. In such an embodiment, the second sheet may include a reinforcing member with a square profile while the first sheet may include a reinforcing member with an oval profile. The pallet may be disassembled to allow for nesting of the sheets. In this embodiment where the structure of the second sheet differs from that of the first sheet, the first sheet may nest upon a first sheet of another pallet while the second sheet may nest upon a second sheet of the other pallet.

In another aspect, the second sheet may have a structure substantially similar to the structure of the first sheet. In this embodiment, the pallet may be disassembled and the first sheet may nest on top of the second sheet since both structures are identical or substantially similar.

The invention further comprises a method for stacking decks when the decks are not bearing a load. The method comprises: providing a first deck having a first top surface and a first bottom surface substantially parallel and opposite to the first top surface; forming a first plurality of channels and ridges in the first deck to form a plurality of channels and ridges in the first top surface and a corresponding plurality of channels and ridges in the first bottom surface wherein each ridge in the first top surface corresponds to a channel in the first bottom surface and each channel in the first top surface corresponds to a ridge in the first bottom surface; providing a second deck with a substantially similar structure as a structure of the first deck, wherein the second deck has a second top surface and a second bottom surface substantially parallel and opposite to the second top surface; forming a second plurality of channels and ridges in the second deck to form a plurality of channels and ridges in the second top surface and a corresponding plurality of channels and ridges in the second bottom surface wherein each ridge in the second top surface corresponds to a channel in the second bottom surface and each channel in the second top surface corresponds to a ridge in the second bottom surface; and stacking the first deck on top of the second deck wherein a ridge in the first bottom surface nests on top of a channel in the second top surface and a channel in the first bottom surface nests on top of a ridge in the second top surface.

It is to be expressly understood that the terms "first deck" and "second deck" include decks which are coupled to each other to form a dual deck pallet, as well as decks which are separate from each other wherein each deck is a pallet unto itself.

The method further comprises forming a first plurality of depressions in the first top surface corresponding to an equal number of legs extending from the first bottom surface; and forming a second plurality of depressions in the second top surface corresponding to an equal number of legs extending from the second bottom surface. The method may further comprise nesting each leg extending from the first bottom surface of the first deck with a corresponding depression on the second top surface of the second deck.

If a first runner is removably coupled to at least two of the legs extending from the first bottom surface and a second runner is removably coupled to at least two of the legs extending from the second bottom surface when the decks are in use, the method further comprises: removing the first runner from the at least two legs extending from the first bottom surface; removing the second runner from the at least two legs extending from the second bottom surface; and nesting each leg extending from the first bottom surface with a corresponding depression on the second top surface.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

FIG. 1 is a top plan view of a single deck pallet.

FIG. 2 is a cross-sectional side view of the pallet of FIG. 1 taken along line 2—2.

FIG. 3 is a magnified view of a reinforcing member of the pallet of FIG. 2 positioned within a peripheral channel.

DETAILED DESCRIPTION OF THE PREFERRED EMBODIMENTS

Figure 4:
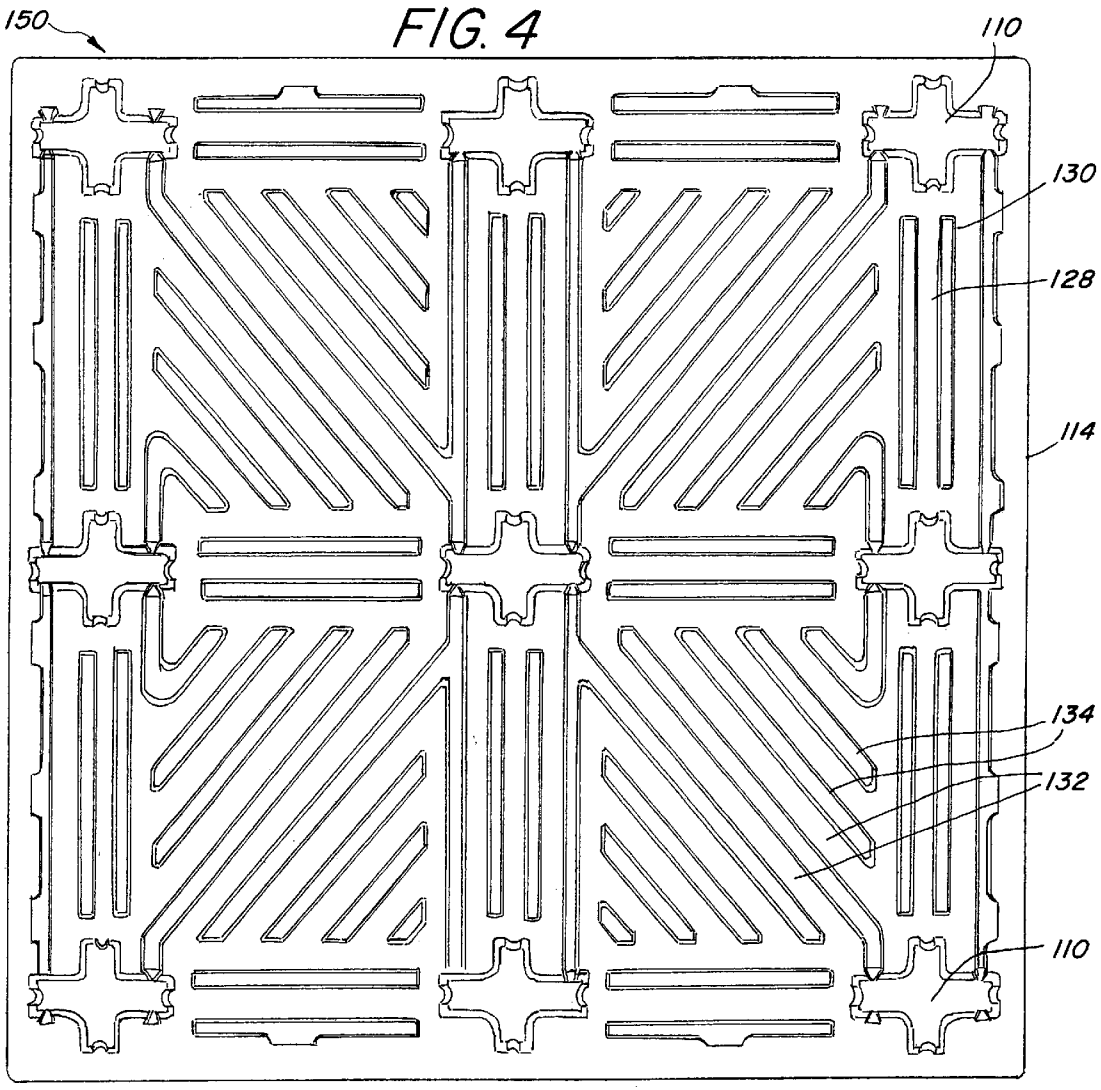
FIG. 4 is a top plan view of a legged dual deck pallet.

The following description is provided to enable any person skilled in the art to make and use the invention and sets forth the best modes contemplated by the inventors of carrying out their invention. Various modifications, however, will remain readily apparent to those skilled in the art, as the generic principles of the present invention have been defined herein for providing an improved pallet.

The pallet of the invention includes at least an upper deck formed of a sheet of rigid but formable material, such as plastic or metal, with a load engaging surface on one side of the sheet, and a lift engaging surface on the other. A number of features such as ridges and channels are formed in the sheet with corresponding features being defined by the sheet on the opposite side. In other embodiments, the pallet may further include a lower deck or other support structure, and may further include integral reinforcing members. A detailed description of several exemplary embodiments of the invention will now be made with reference to the figures listed above and wherein like features are identified by like numbers.

Referring now to FIGS. 1 and 2, a first embodiment of the pallet of the invention is shown generally referenced by the number 100. The pallet 100 is preferably fabricated from a single sheet, and comprises an approximately planar upper deck 102, with an upper load bearing surface 104 and on the opposite side a lower lifting surface 106. The upper deck 102 is preferably substantially rectangular, and is of a standard pallet size, typically 1200 to 1300 mm in length and 800 to 1,000 mm in width, although the pallet 100 may be made in any useful or desired size or shape. In the preferred embodiment, the upper deck 102 has four edges disposed at right angles to each other to form the shape of a rectangle. The four edges define the periphery of the upper deck 102. There are preferably nine legs 108, best seen in FIG. 2, formed in three rows of three, thereby forming two gaps between the legs 108 on each side of the pallet 100. However, in alternate embodiments, more or less than nine legs 108 may be used. The size of the gaps will depend on the size and length of the legs 108. These gaps allow the tines of a forklift to enter under the upper deck 102 from any side to engage the lifting surface 106 to lift the pallet 100.

The pallet 100 is preferably formed of a High Density Polyethylene (HDPE) compound, of a suitable relatively constant thickness. However, in alternate embodiments, any useful or practical material may be used, including any desired plastics and plastic alloys or metal sheets, such as aluminum. In embodiments using HDPE, the thickness and density of the sheet material used to fabricate the pallet 100 may be varied depending on the load requirements for which the pallet 100 is intended and the strength characteristics of the materials used in constructing the pallet 100. It is preferable that the thickness of the sheet material used to fabricate the pallet 100 range between 5 and 10 millimeters, and more preferably between 6 and 8 millimeters, depending on whether a light or heavy-duty pallet is required. The density of the HDPE material comprising the sheet is preferably between 1.15 and 1.20 grams per cubic centimeter, and most preferably approximately 1.18 grams per cubic centimeter.

It is a particular advantage of the pallet of the invention that the materials used in fabrication can be chosen for custom uses, for example, the sheet material may be selected for resistance to damage in cold environments or exposure to selected chemicals, such as detergents, acids, alkalis, salts, and sea water, or ultra violet sunlight. Furthermore, thermoplastic materials such as HDPE can be readily fabricated in a variety of custom colors, and the colors can be used to color code the materials loaded on the pallets for easy identification.

A number of features, including ridges, channels, and depressions, are formed in the sheet material of the upper deck 102. In all embodiments described herein, the lifting, or bottom, surface of each sheet is substantially parallel to the opposing top surface such that features or configurations on one side of the sheet will have corresponding features or configurations on the opposite side. For example, a top ridge formed in the top or load bearing surface 104 of the upper deck 102 defines a corresponding bottom channel in the bottom or lifting surface 106 of the upper deck 102. Similarly, a top channel formed in the load bearing surface 104 of the upper deck 102 defines a corresponding bottom ridge in the lifting surface 106 of the upper deck 102. Referring again to FIG. 1, a plurality of tapered leg depressions 110 in the upper load bearing surface 104 correspond to a plurality of legs 108 extending downward from the lifting surface 106. The leg depression 110 and corresponding legs 108 preferably extend to a flat end, and are preferably of the same length so that the weight of the pallet 100 is evenly distributed among the legs 108. The legs 108 preferably extend sufficiently beyond the depth of other features on the lower lifting surface 106 of the upper deck 102 so that gaps between adjacent legs 108 are sufficient to allow the tines of a forklift to enter under upper deck 102 to raise or move the pallet 100. The leg depressions 110 and corresponding legs 108 may be any desired or practical shape such as circular, oval, triangular or quadrilateral in cross-section. However, in the embodiment seen in FIG. 1, nine leg depressions 110 are cross-shape in cross-section. All of the leg depressions 110 are preferably tapered so that the area of the bottom of each leg depression 110 is smaller than the area of the opening at the top of the leg depression 110. Thus, the legs 108 decrease in cross section as the distance from the lower lifting surface 106 increases. The preferred angle of taper is between 4 and 8 degrees from vertical, and more preferably between 5 and 6 degrees from vertical. The taper of the legs 108 facilitates space saving nesting of the pallets when stored.

The pallet 100 is surrounded by a peripheral flange 114 defining a ridge 116 on the periphery of the upper load bearing surface 104, and a corresponding channel 118 on the lower lift bearing surface. The peripheral ridge 116, and its corresponding peripheral channel 118, are formed adjacent to the periphery of the upper deck 102. The geometry of the peripheral flange 114 is preferably chosen to inhibit bending, flexing or buckling of the upper deck 102 at the periphery of the pallet 100. As shown in FIG. 2 and magnified in FIG. 3, the peripheral channel 118 is substantially U-shaped, and, therefore unsealed. In FIGS. 2 and 3, the peripheral channel 118 has an opening along a bottom side of the upper deck 102 that allows a reinforcing member 120 to be received in the peripheral channel 118 via the opening. In the embodiment seen in FIG. 1, a reinforcing member 120 is received within the peripheral channel 118 of the peripheral flange 114 to add additional strength. The reinforcing member 120 may be any practical material, however, the preferred configuration of the reinforcing member 120 is a steel structural member 122 encapsulated in a thermoplastic material 124. Encapsulation of the steel structural member has the advantage of protecting the steel structural member from corrosive forces. The reinforcing member 120 may be a unitary ring dimensioned to be received within the peripheral channel 118, or more preferably four separate elongate reinforcing members, with one elongate member positioned within the peripheral channel 118 on each side of the pallet 100. The encapsulating thermoplastic material 124 of the reinforcing member 120 is preferably fully compatible with the material used in the manufacture of the upper deck 102 so that the reinforcing member 120 may be heat welded or fused to the upper deck 102 within the peripheral channel 118 to form a unitary object. The definition of the word "fuse" is intend to include a process whereby a molecular structure of one part is cross-linked to a molecular structure of another part. In alternate embodiments, the reinforcing member 120 may be coupled within the peripheral channel 118 using an adhesive. The steel structural member 122 of the reinforcing member 120 is preferably a steel bar that is oval in cross section, although other desired shapes may be used. The reinforcing member 120 is preferably positioned within the peripheral channel 118 with a long axis of the oval approximately perpendicular to the plane of the load bearing surface 104 of the upper deck 102.

A plurality of ridges are defined by depressions and channels in the load bearing surface 104 of the upper deck 102. As previously explained, corresponding features exist on the lifting surface 106 of the upper deck 102. The ridges and channels are preferably arranged to provide additional resistance to bending, flexing or buckling of the upper deck 102. A preferred arrangement of the ridges and channels is seen in FIG. 1, which shows a plurality of channels 128 and ridges 130 extending between adjacent leg depressions 110. Thus, the upper load bearing surface 104 is divided into four squares. Within each square, a plurality of ridges 132 and channels 134 radiate diagonally from the center leg depression 110 towards a corner leg depression 110. The ridges, and corresponding channels, preferably have a tapered cross section and a flat top. The angle of taper is preferably between 6 and 8 degrees from vertical, and more preferably approximately 8 degrees from vertical. The tops of the ridges 128, 132 define a plane, just as the tops of the ridges on the lower lifting surface 106 of the upper deck 102 define a parallel plane. The height of the ridges 128, 132 measured relative to the depth of an adjacent channels 130, 134 is preferably between 25 and 32 millimeters, and more preferably between 28 and 30 millimeters. The depth of a channels measured from an adjacent ridge will be correspondingly the same.

The configuration of the ridges and channels, together with the manner in which the legs 108 are constructed, allow the pallet 100 to achieve a very high strength without a significant increase in the amount of material used to construct the pallet 100. The configuration of channels and ridges shown in FIG. 1 is intended to increase stability and load bearing strength of pallet 100 without creating areas of weakness susceptible to structural failure. In alternate embodiments, alternate configurations of ridges and channels may be used. For example, the number and orientation of ridges used can vary greatly, and in alternate embodiments the ridges may be V or U shaped in cross section.

The ridges 128 and 132 may act to prevent movement of a load on the pallet 100. However, in an alternate embodiment, an anti-slip or friction coating may be added to the load bearing surface 104. The friction coating may be painted onto the load bearing surface 104, or laminated or otherwise adhesively affixed onto the load bearing surface 104. If laminated, the friction coating or film may preferably be added by co-extrusion of the film and the sheet material used to fabricate the upper deck 102. In a further alternate embodiment, a texture may be formed in the load bearing surface 104 during the vacuum molding process.

The pallet 100 is particularly well adapted for self-draining. The configuration of the channels 130 and 134 may be modified to provide a continuous draining channel by creating communication between the channels 130 and 134 and the leg depressions 110. Thus if the pallet 100 is used to for moving or storage of liquid containers or agricultural materials, fluids that leak from the containers or agricultural materials may be directed toward the leg depressions 110. In some embodiments, apertures may be further provided in the leg depressions 110 to allow the fluids to drain from the pallet 100.

The pallet 100 of the invention is particularly constructed so as to be readily manufacturable through a vacuum thermoforming process, wherein the sheet of formable material is heated and vacuum formed against a mold to produce the desired pallet configuration. In construction, the sheet material used to manufacture the pallet 100 of the invention is mounted onto a thermoform vacuum mold. The thermoform vacuum mold is preferably a one sided mold having vacuum ports to draw the sheet material against the mold, with the sheet material being heated so as to generally conform to the shape of the mold. In embodiments including reinforcing members 120, the reinforcing member 120 is pressed into the peripheral channel 118 under pressure while the sheet and/or encapsulating coating 124 encapsulating the structural member 122 is in a semi-molten state so that they fuse forming unitary object.

Figure 5:
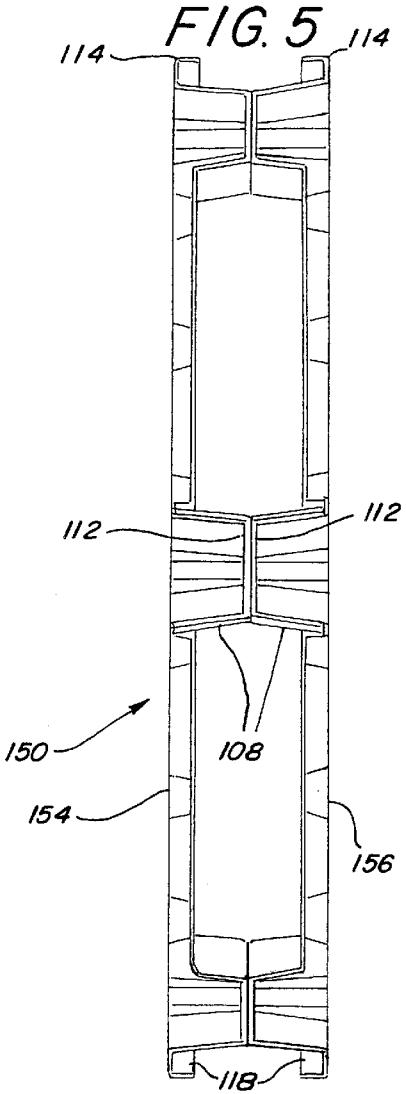
FIG. 5 is a cross-sectional side view of the pallet of FIG. 4 taken along line 5—5.

FIGS. 4 and 5 illustrate a double deck embodiment of the pallet of the invention. In this embodiment, two identical deck portions are joined at the flat ends 112 of the legs 108 to form the pallet 150 having an upper deck 154 and an identical lower deck 156. The use of a lower deck 156 increases the stability of the pallet 150 when stacked or placed on an uneven surface. The upper and lower decks 154, 156 are preferably joined at the legs 108 by heat welding, however, adhesives or mechanical coupling means such as metal or plastic rivets or bolts may be equally useable. The configuration of ridges and channels shown in FIG. 4 is somewhat different than that shown in FIG. 1. However, the configuration and fabrication of the upper deck 154 of the pallet 150 is otherwise the same as that discussed in relation to the upper deck 102 of the pallet 100 of FIG. 1.

FIG. 5 shows a cross-sectional view of the pallet 100 of FIG. 4 taken along line 5—5. No reinforcing members are used in this pallet 100, however, reinforcing members could easily be added by fusing the reinforcing members into the peripheral channel 118 as previously described in the pallet of FIG. 1.

Figure 8:
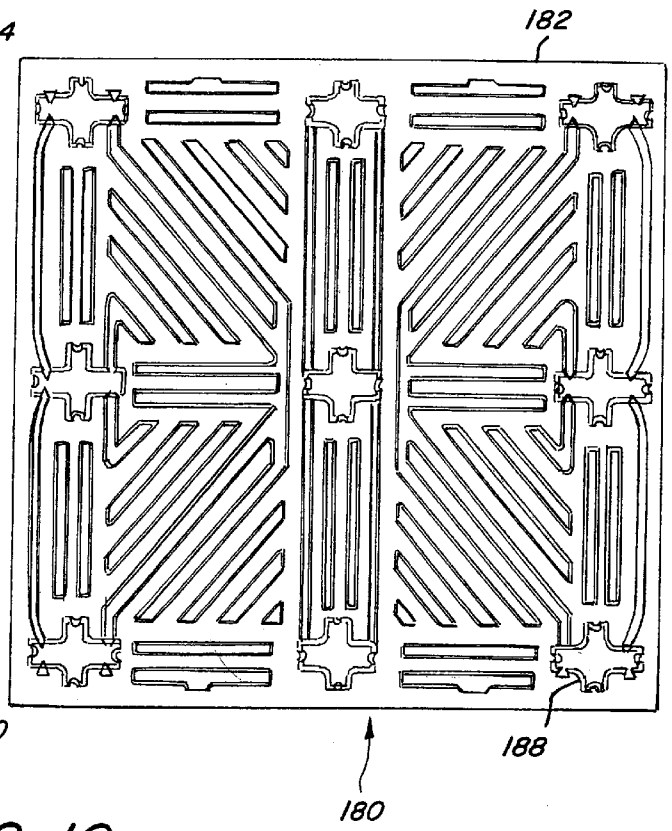
FIG. 8 is a top plan view of the upper deck of the pallet of FIG. 6.
Figure 7:
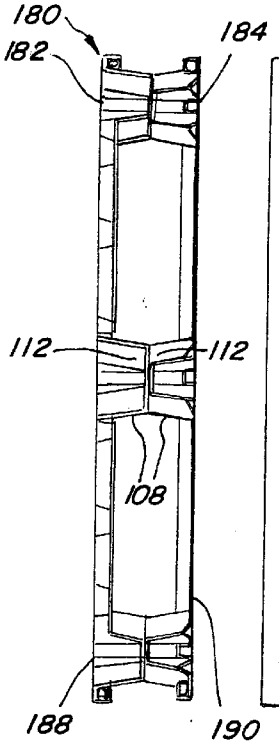
FIG. 7 is a cross-sectional side view of the dual deck pallet of FIG. 6 taken along line 7—7.
Figure 6:
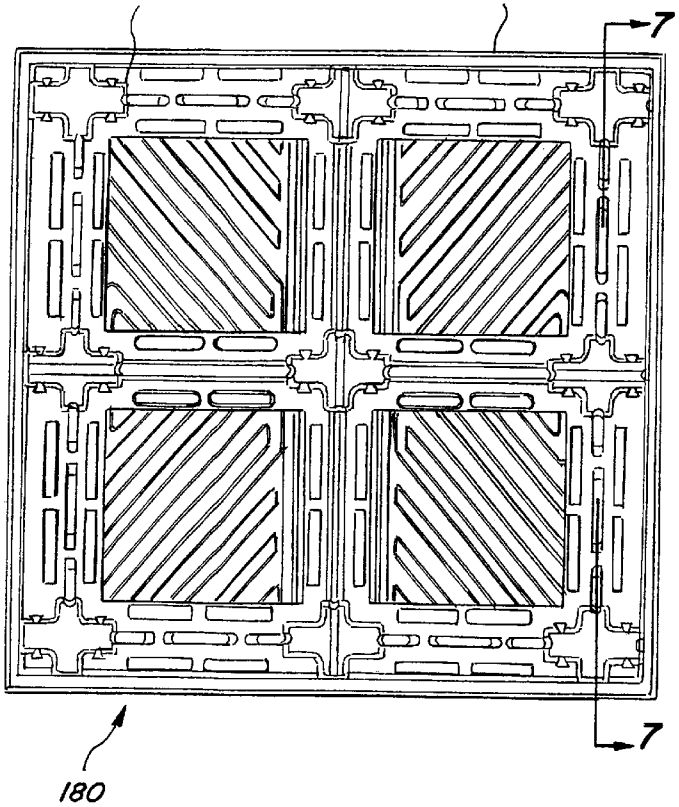
FIG. 6 is a bottom plan view of an alternate embodiment of the legged dual deck pallet.

FIGS. 6, 7, and 8 show bottom, cross-sectional, and top views, respectively, of a double deck embodiment of the pallet 180 wherein the load bearing surface 188 of the upper deck 182, seen in FIG. 8, and the bottom surface 190 of the lower deck 184, seen in FIG. 6, are not configured identically. In this embodiment, the lower deck 184 can be specialized or customized to provide maximum strength and stability when used for specialized stacking or storing purposes. In the embodiment shown, both the upper deck 182 and the lower deck 184 include a reinforcing member, best seen in FIGS. 7, 9, and 10. FIG. 7 shows a cross-sectional view of FIG. 6 taken along line 7—7. The upper deck 182 and the lower deck 184 can be seen joined at the ends 112 of the legs 108. As in previous embodiments, the legs of the upper deck 182 and the lower deck 184 are preferably joined by fusing the material from which the upper and lower decks 182, 184 are fabricated at the point of contact.

Figure 9:
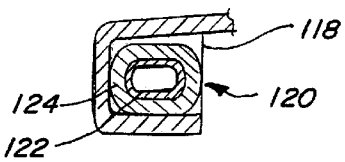
FIG. 9 is a magnified view of the reinforcing member of the pallet of FIG. 7 positioned within the peripheral channel of the upper deck.

FIG. 9 shows a magnified view of the reinforcing member 120 within the peripheral channel 118 of the upper deck 182. The configuration of the peripheral channel 118 and the reinforcing member 120 of the upper deck 182 is similar to that previously described relating to the upper deck 102 of FIG. 1, wherein the reinforcing member comprises a structural member 122, preferably a steel bar, having an oval cross section, encased within a thermoplastic coating 124, disposed within the peripheral channel 118 with the long axis of the oval being approximately perpendicular to the plane of the upper deck 182.

Figure 10:
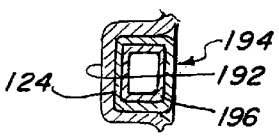
FIG. 10 is a magnified view of the reinforcing member of the pallet of FIG. 7 positioned within the peripheral channel of the lower deck.

However, the configuration of the peripheral channel 192 and the reinforcing member 194 of the lower deck 184 is different than the configuration the peripheral channel 118 and reinforcing member 120 of the upper deck 182. FIG. 10, shows a magnified cross-sectional view of the reinforcing member 194 of the lower deck 184 of the pallet 180 of FIG. 7. The peripheral channel 192 of the lower deck 184 opens toward the bottom surface 190 of the lower deck 184. The reinforcing member 194, received within the peripheral channel 192 of the lower deck 184, is preferably comprised of a structural member 196, preferably a steel bar, that is square or oval in cross-section and encased within thermoplastic material 124. The flat edge of the reinforcing member 194 provides a stable base for the pallet 180.

In alternate embodiments of two deck pallets, the lower deck may not include legs 108, and may instead have depressions or other structures to receive the legs 108 from the upper deck 102. In this embodiment, the legs 108 of the upper deck 102 would preferably be lengthened to maintain an appropriate gap for entry of the tines of a forklift.

Figure 11:
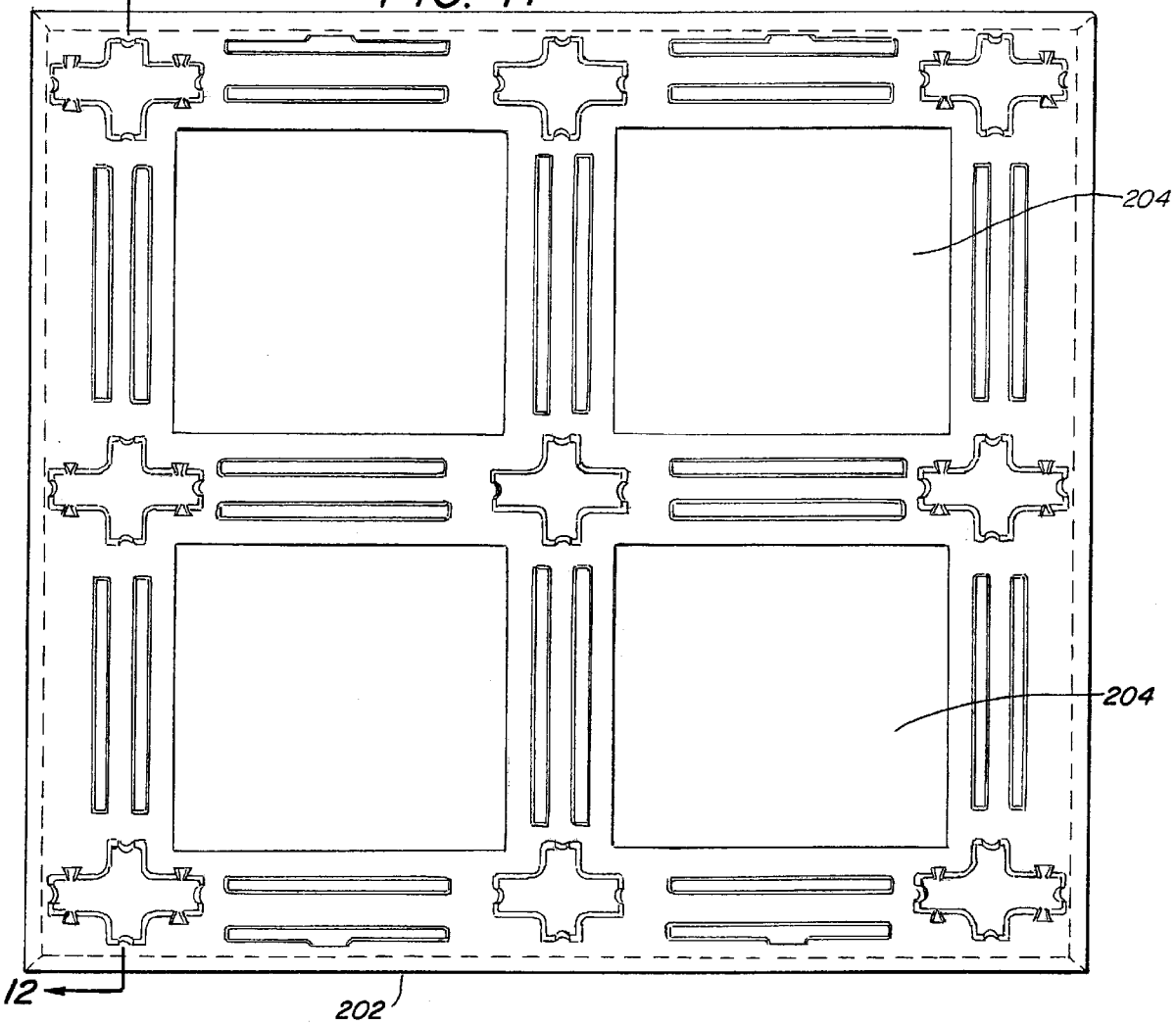
FIG. 11 is a bottom plan view of the lower deck of the pallet in FIGS. 6, 7 and 8.
Figure 12:
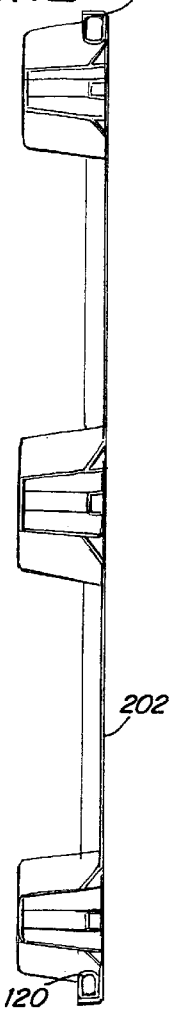
FIG. 12 is a cross sectional view of the pallet of FIG. 11 taken along line 12—12.

FIGS. 11 and 12 show an alternate embodiment of a lower deck 202 that includes open areas 204. FIG. 11 shows a plan view of the bottom surface 206 of the lower deck 202. The open areas 204 are provided so that less material is used in the fabrication of the lower deck 202, resulting in a lighter and less expensive pallet configuration. The open area 204 also allows the pallet to be used with a "pallet jack" as well as a fork lift truck. In this case, the front wheels of the pallet jack work through the open areas. A slope on the deck edge allows easy access for the pallet jack to enter. FIG. 12 shows a cross-sectional view of the lower deck 202 of FIG. 11 along line 12—12. In the embodiment shown, the configuration of the reinforcing members 120 in the lower deck is the same as that shown in FIG. 10. However, in alternate embodiments, the reinforcing members 120 need not be included. The construction and fabrication of the lower deck 202 of FIGS. 11 and 12 are otherwise the same as that described in earlier embodiments.

Figure 13:
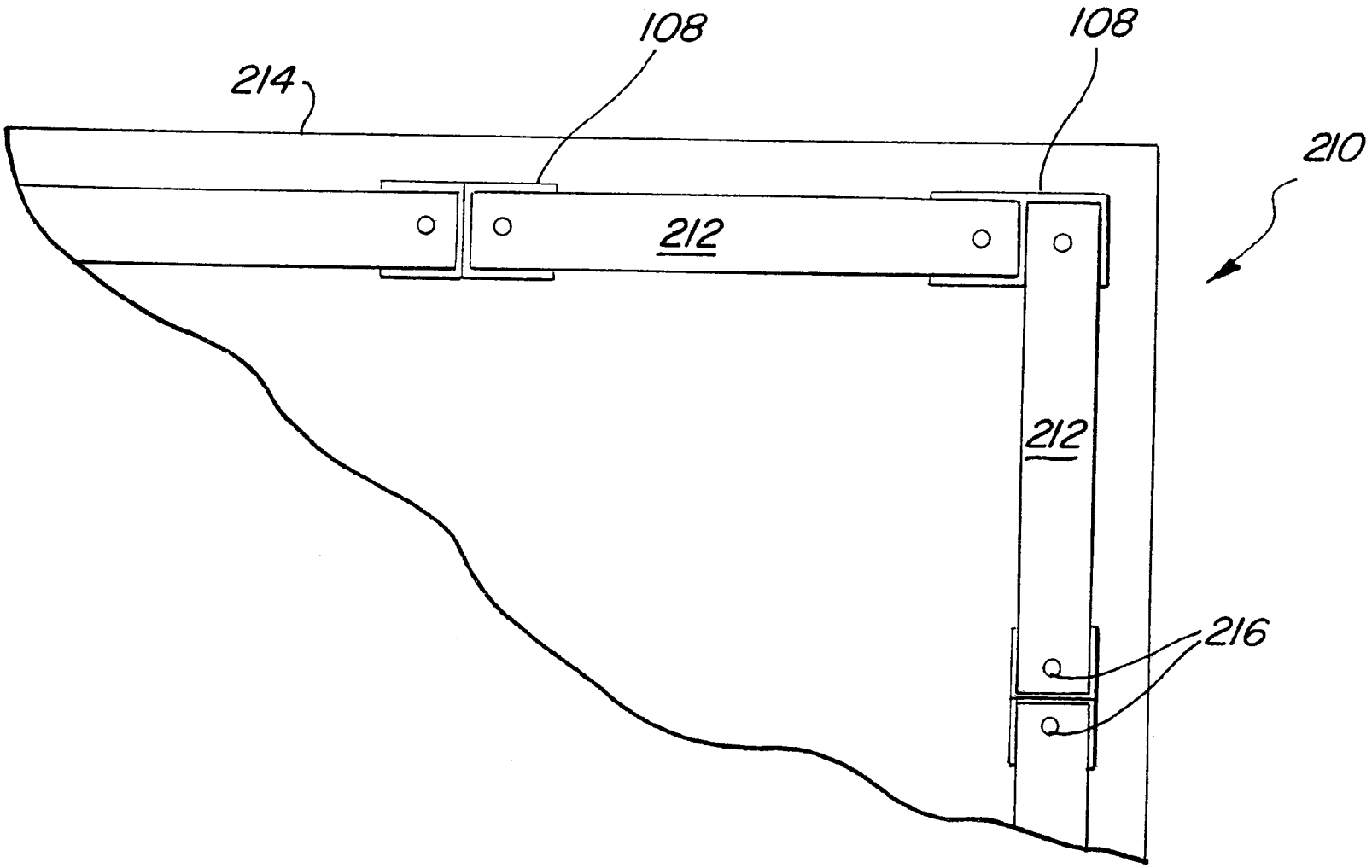
FIG. 13 is a bottom plan view of a portion of the lifting surface of a single deck pallet with runners coupled between adjacent legs.

FIG. 13 shows a bottom plan view of a single deck pallet embodiment 210 having wooden runners 212 coupled to the bottoms 112 of legs 108 of the upper deck 214 of the pallet 210 using plastic rivets 216, although any other known means for coupling the runners may be used, including adhesives, staples, nails, and screws.

Figure 14:
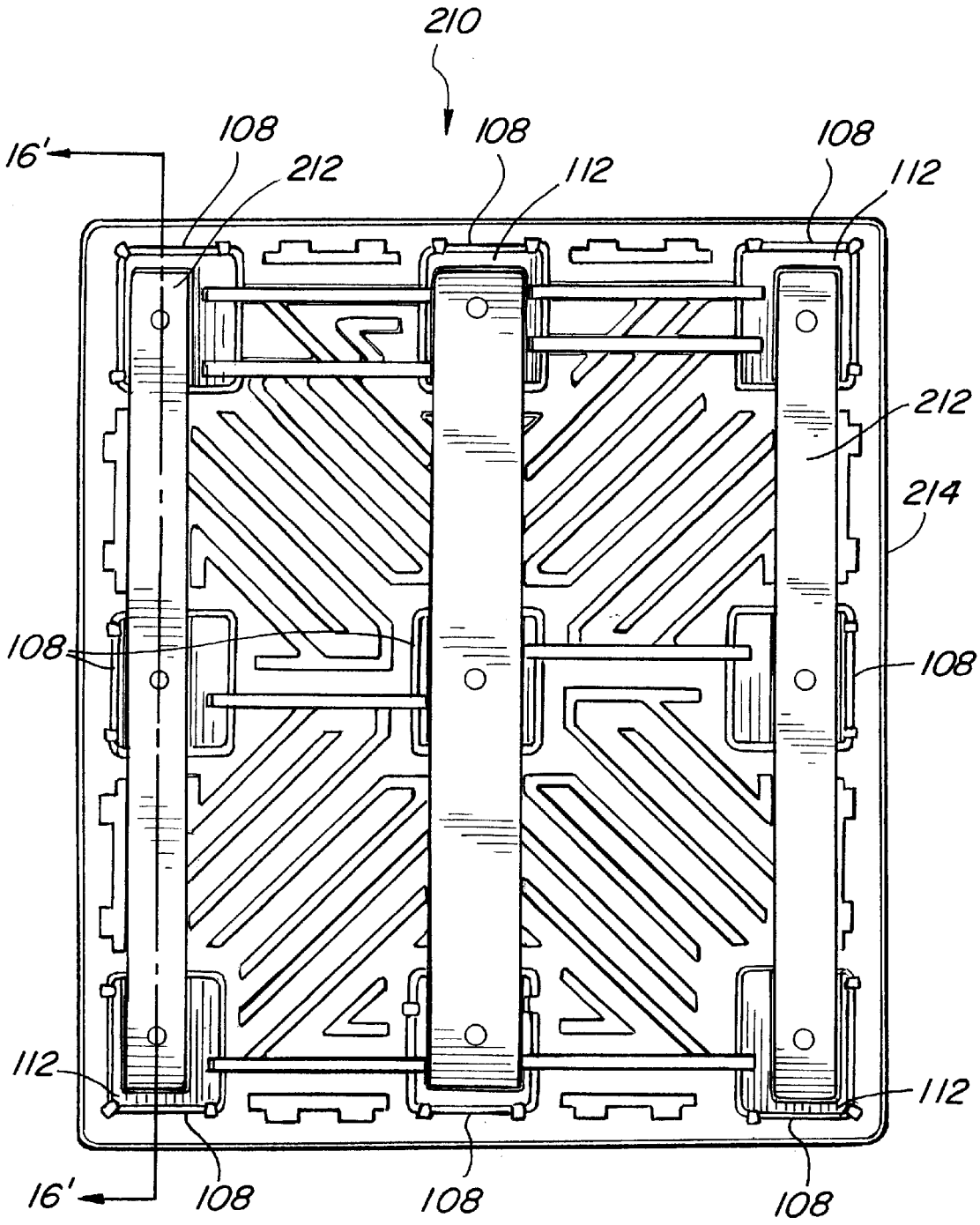
FIG. 14 is a bottom plan view of an alternate embodiment of a single deck pallet with runners.

FIG. 14 is a bottom plan view of an alternate embodiment of a single deck pallet embodiment 210 with runners 212 coupled to the bottoms 112 of legs 108 of a deck 214. The runners 212 extend substantially along the length of the deck 214 such that each runner 212 is coupled to an entire row of legs 108. Thus, in the preferred embodiment having nine legs 108 arranged accordingly in three rows, three runners 212 may be coupled to the deck 214 with each runner 212 coupled to a row of three legs 108.

Figure 15:
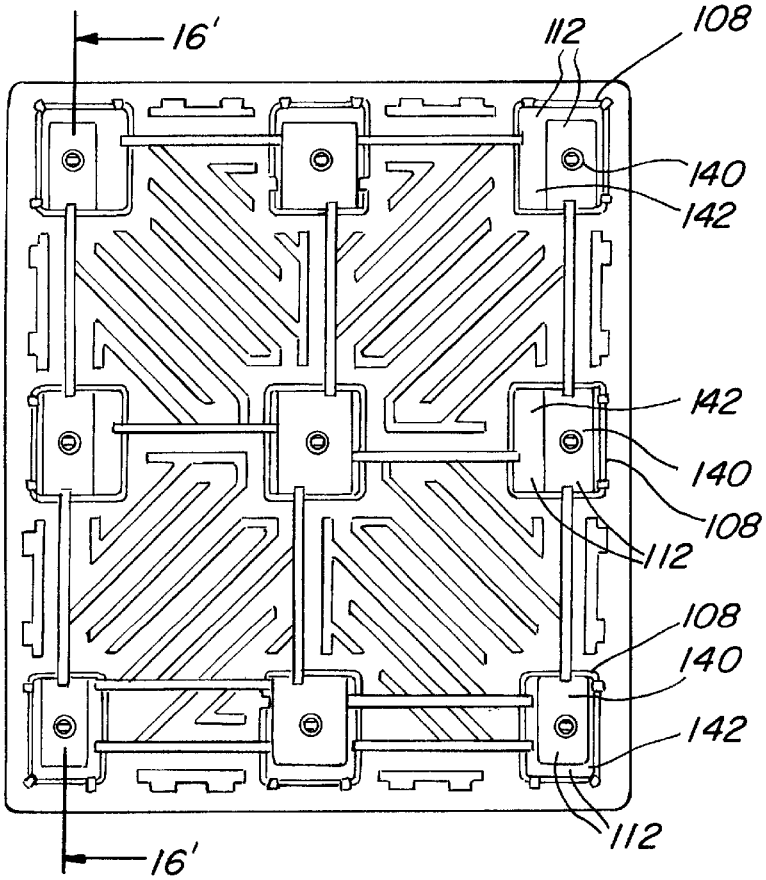
FIG. 15 is a bottom plan view of the single deck pallet in FIG. 14 with the runners removed.
Figure 16:
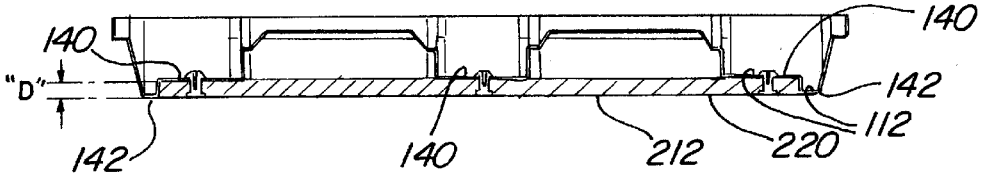
FIG. 16 is a cross-sectional view of the pallet in FIG. 14 taken along lines 16'—16'.

In FIG. 15, the runners are removed to illustrate the structure of the leg bottoms 112. The leg bottoms 112 each include a recessed portion 140 and a raised shoulder, or exposed, portion 142. Each recessed portion 140 is shaped to receive a portion of a runner. In FIG. 16, the recessed portion 140 has a depth "D" configured such that when the runner 212 is sunken into the recessed portions 140, a bottom surface 220 of the runner 212 is substantially flush with the shoulder portion 142 of the leg bottom 112. This structure of the leg bottom 112 provides a more secure fit for the runners 212 and a greater contact surface area upon which the pallet 210 may rest, thus increasing the stability and weight capacity of the pallet 210. The greater contact surface area provided by the shoulders 142 also enables the pallet 210, to:

1) support additional weight without bowing; and
2) be stacked on top of malleable packages retained by a lower pallet. Since the greater contact surface area provided by the shoulders 142 distributes the entire weight of the pallet 210 more evenly, the pallet 210 may support additional weight without damaging the merchandise upon which it is stacked.

Figure 17:
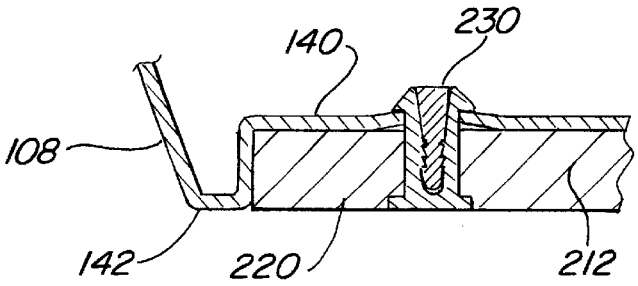
FIG. 17 is a close-up view of the encircled area "P" in FIG. 16.

In FIG. 17, the runners 212 are removably coupled to the legs 108 with a securing mechanism 230, such as a locking pin, though any type of securing mechanism may be used which allows a user to remove the runners 212. The locking pin 230 is designed such that a user may repeatedly detach and reattach the runners 212 with ease, depending on whether the pallets are in use. FIG. 17 also provides a close-up view of the flush attribute between the bottom surface 220 of the runner 212 and the shoulder portion 142 of the leg bottom 112.

Figure 18:
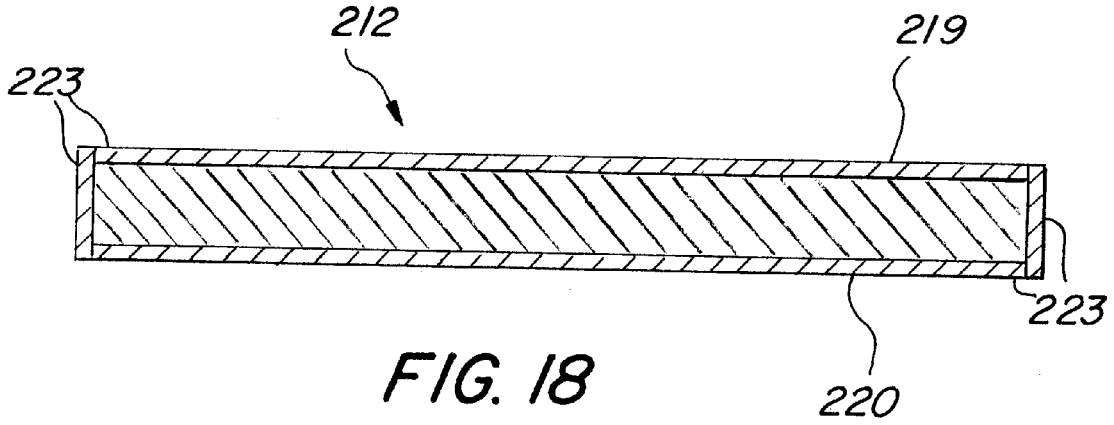
FIG. 18 is a cross-sectional view of the runner.
Figure 19:
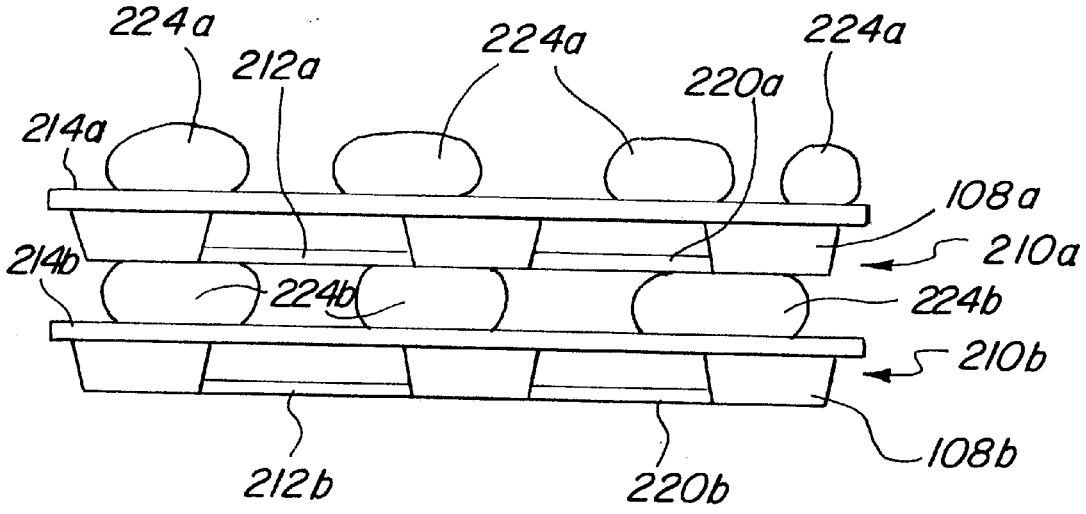
FIG. 19 is a side elevation view of an operative configuration of a stack of pallets with runners.

FIG. 18 is a cross-sectional view of the runner 212. The runner 212 has a substantially flat top and bottom surface 219, 220. This is especially important when pallets 210, carrying malleable packages which are not boxes, are being stacked on top of each other as shown in FIG. 19. The runners 212 may comprise any rigid material, including wood, metal, or plastic. The runners 212 are entirely encapsulated with a thick thermoplastic layer 223. In the preferred embodiment, the runners 212 are made of wood and entirely encapsulated with HDPE 223.

FIG. 19 illustrates two substantially identical pallets 210*a*, 210*b* wherein elements of similar structure are designated by the same reference numerals followed by the lower case "a" in the first pallet 210*a*, and the lower case "b" in the second pallet 210*b*. The flat bottom surface 220*a* of each runner 212*a* coupled to the upper pallet 210*a* rests on top of the packages 224*b* loaded onto the lower pallet 210*b*. The flat bottom surfaces 220*a* of the runners 212*a* along with the shoulders 142*a* of the leg 108*a* provide even weight distribution so as to prevent the weight of the upper pallet 210*a*, including packages 224*a* placed thereon, from the crushing, piercing or damaging the packages 224*b* on the lower pallet 210*b*. The runners 212*a*, 212*b* also increases stability of the pallet 210*a*, 210*b* when the pallets 210*a*, 210*b* are being stacked or placed on an uneven surface. Thus, the runners 212*a* allow the upper pallet 210*a* to take on additional weight 224*a* without damaging the merchandise 224*b* upon which the upper pallet 210*a* is resting. The runners 212*a*, 212*b* also prevent the decks 214*a*, 214*b*, respectively, from bowing.

Figure 20:
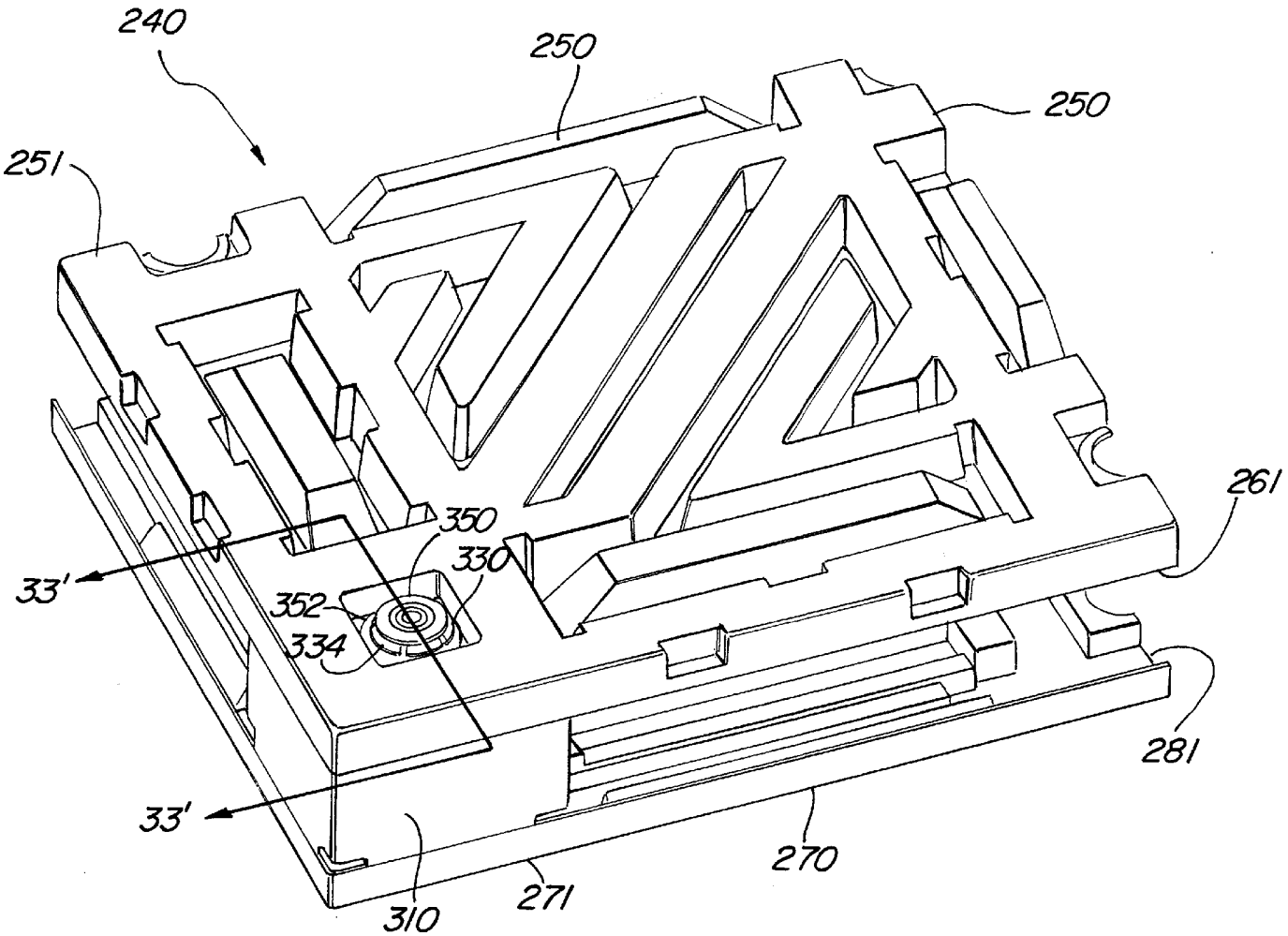
FIG. 20 is perspective view of a modular, non-legged dual deck pallet.
Figure 21A:
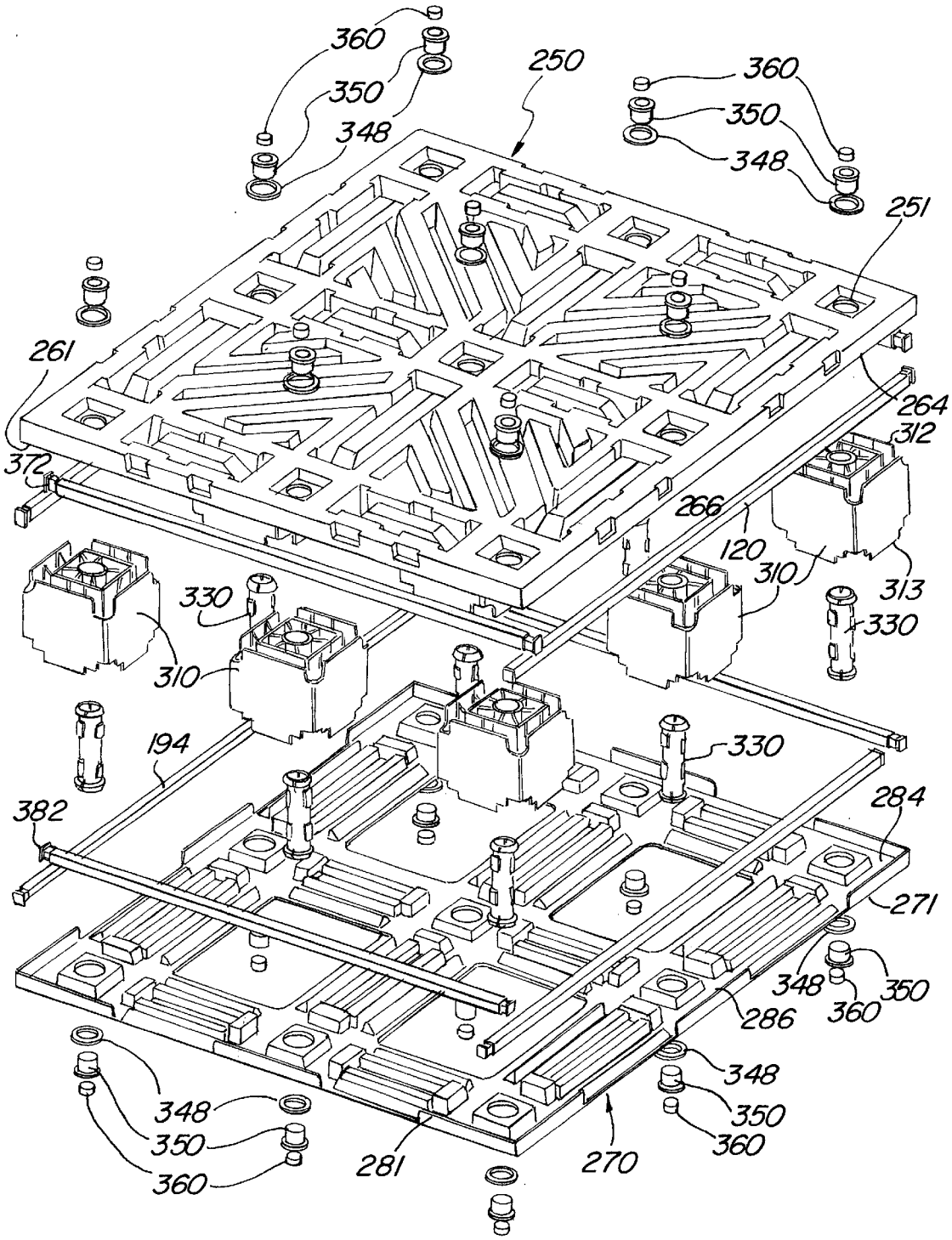
FIG. 21*a* is an exploded view of the modular, non-legged dual deck pallet wherein the lower deck has a different structure than a structure of the upper deck.

The invention further comprises a modular dual deck pallet without legs. The non-legged dual deck pallet 240 is illustrated in perspective view in FIG. 20. In FIG. 20, the non-legged, or legless, dual deck pallet 240 includes an upper deck, or first sheet, 250 and a lower deck, or second sheet, 270. Columns 310 are disposed in between the first sheet 250 and the second sheet 270. In FIG. 21*a*, the second sheet 270 may have a different structure than the first sheet 250. Alternatively, in FIG. 21*b*, the second sheet 270 may have a structure that is substantially similar to the structure of the first sheet 250.

Figure 22:
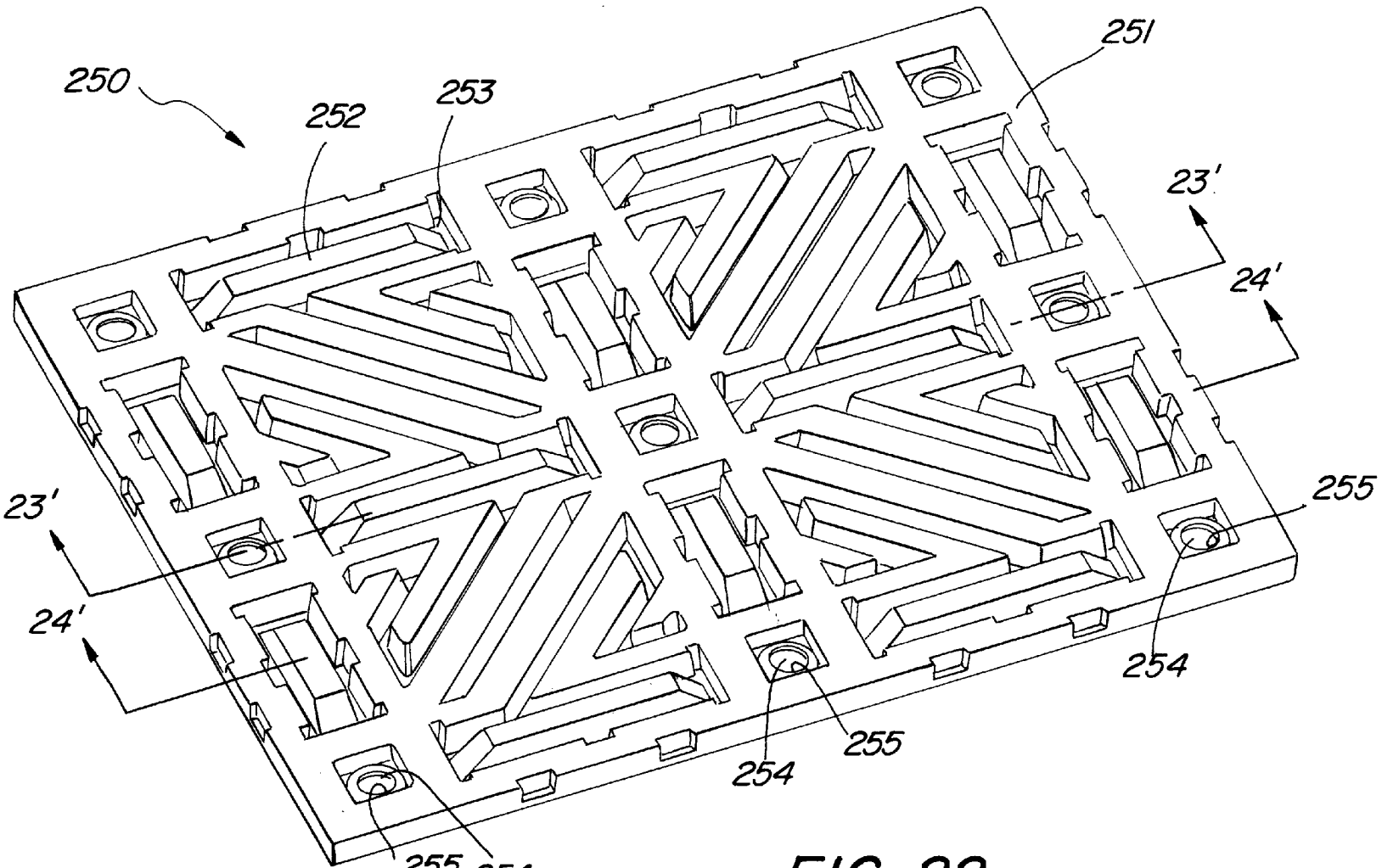
FIG. 22 is a perspective view of a non-legged upper deck in the dual deck pallet of FIG. 20.
Figure 23:
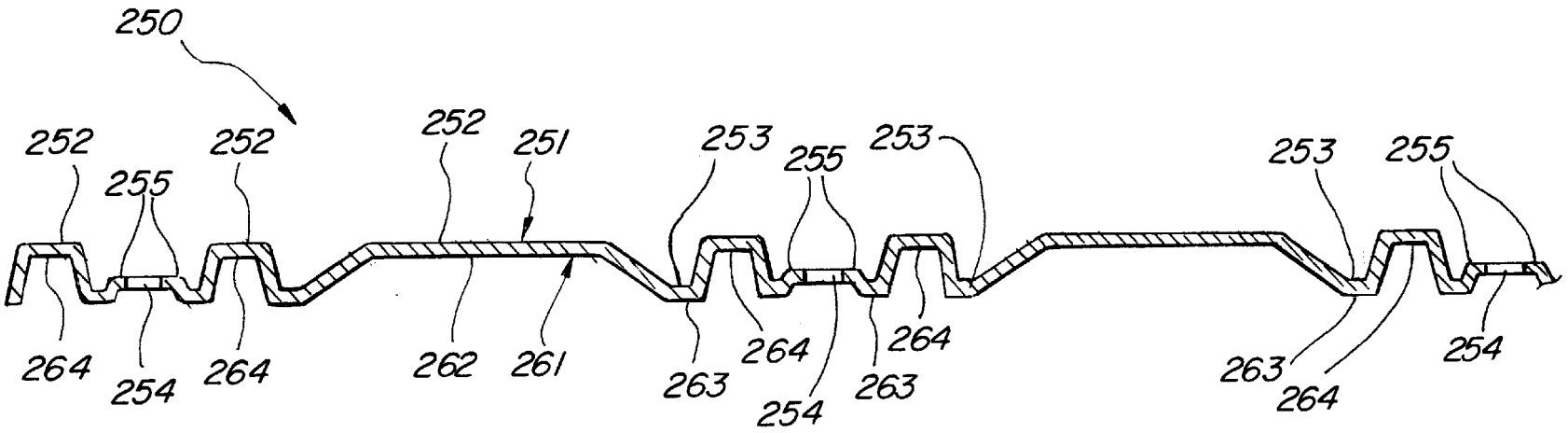
FIG. 23 is a cross-sectional view of the upper deck of FIG. 22 taken along lines 23'—23'.
Figure 24:
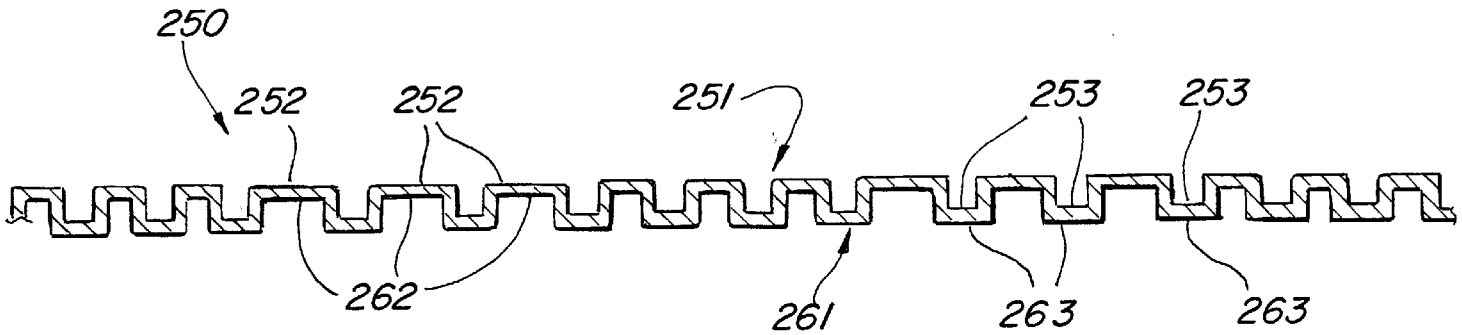
FIG. 24 is a cross-sectional view of the upper deck of FIG. 22 taken along lines 24'—24'.

FIG. 22 is a perspective view of the upper deck 250. FIG. 23 is a cross-sectional view taken along lines 23'—23' of FIG. 22 while FIG. 24 is a cross-section view taken along lines 24'—24' of FIG. 22. The upper deck 250 includes a top, or external, surface 251 and a bottom, or internal, surface 261 substantially parallel and opposite to the top surface 251 as shown in FIGS. 22 and 23. The upper deck 250 comprises a plurality of ridges and channels. In FIGS. 23 and 24, the internal surface 261 is substantially parallel to the external surface 251 such that a ridge 252 on the external surface 251 corresponds to a channel 262 on the internal surface 261 and a channel 253 on the external surface 251 corresponds to a ridge 263 on the internal surface 261. The upper deck 250 comprises a single sheet made of a rigid but formable material. Such a rigid but formable material comprises a thermoplastic material, such as HDPE. In FIG. 22, the upper deck 250 comprises a plurality of apertures 254. A raised shoulder 255 surrounds each aperture 254.

Figure 25:
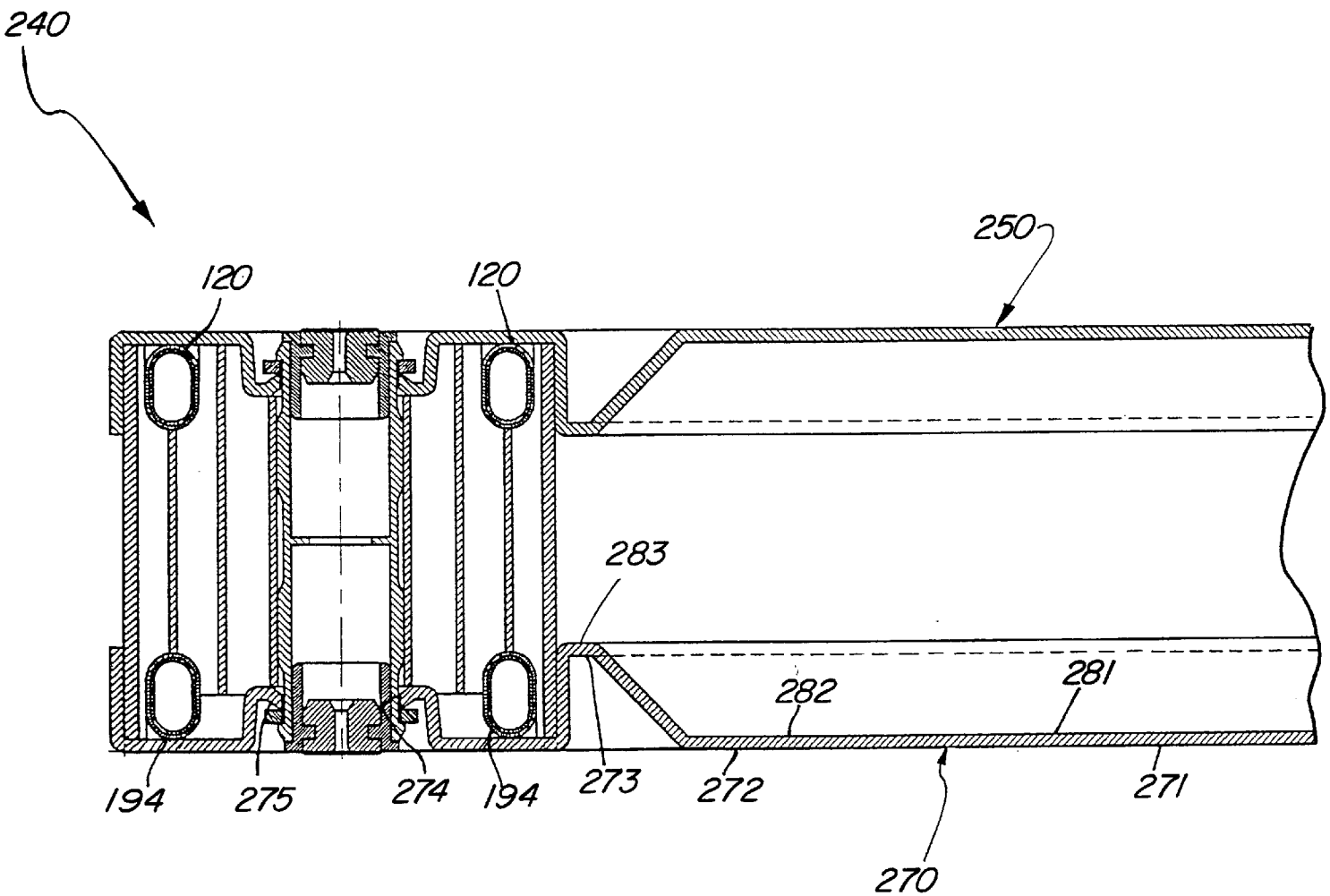
FIG. 25 is a cross-sectional view of a non-legged dual deck pallet wherein the lower pallet has a structure substantially similar to the structure of the upper pallet.

The lower deck 270 may comprise a structure substantially similar to the structure of the upper deck 250 as shown in FIG. 25. The lower deck 270 comprises a second external surface 271 and a second internal surface 281 substantially parallel and opposite to the external surface 271. Since the internal surface 281 is substantially parallel to the external surface 271, a plurality of ridges 272 in the second external surface 271 corresponds to a plurality of channels 282 in the second internal surface 281, and a plurality of channels 273 in the second external surface 271 corresponds to a plurality of rides 283 in the second internal surface 281. Furthermore, a plurality of apertures 274 are defined in the lower deck 270 wherein each aperture is surrounded by a raised shoulder 275. In such a dual deck pallet 240 where the upper and lower decks 250, 270 have the same structure, the upper deck 250 can be nested on top of the lower deck 270 , or vice versa, once the pallet is disassembled.

Figure 26:
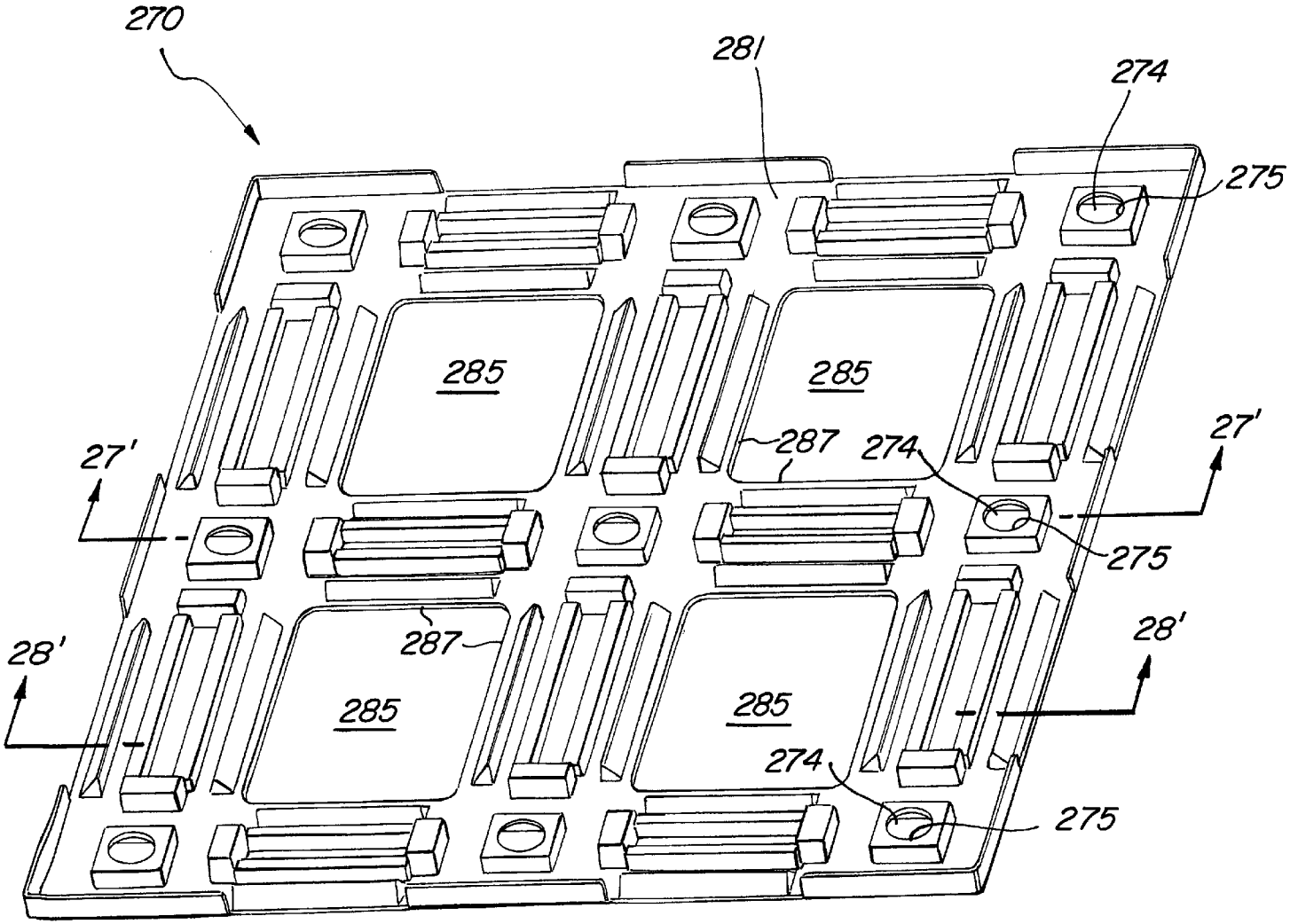
FIG. 26 is a perspective view of a lower deck in the dual deck pallet without legs.

Alternatively, the lower deck 270 may comprise a structure different from that of the upper deck 250. Since the lower deck 270 is not adapted to support any cargo, it may be made from less material than the upper deck 250, thus saving costs. FIG. 26 is a perspective view of the internal surface 281 of such a lower deck 270. The lower deck 270 may comprise large open areas 285 as defined by perpendicular cross members 287, thus reducing the amount of material necessary to make such a deck. The lower deck 270 is made of a rigid but formable material, which includes thermoplastic materials such as HDPE. When this dual deck pallet 240 is disassembled, the upper deck 250 may be nested upon the upper deck of another similarly structured pallet while the lower deck 270 may be nested upon a lower deck of the other pallet.

Figure 27:
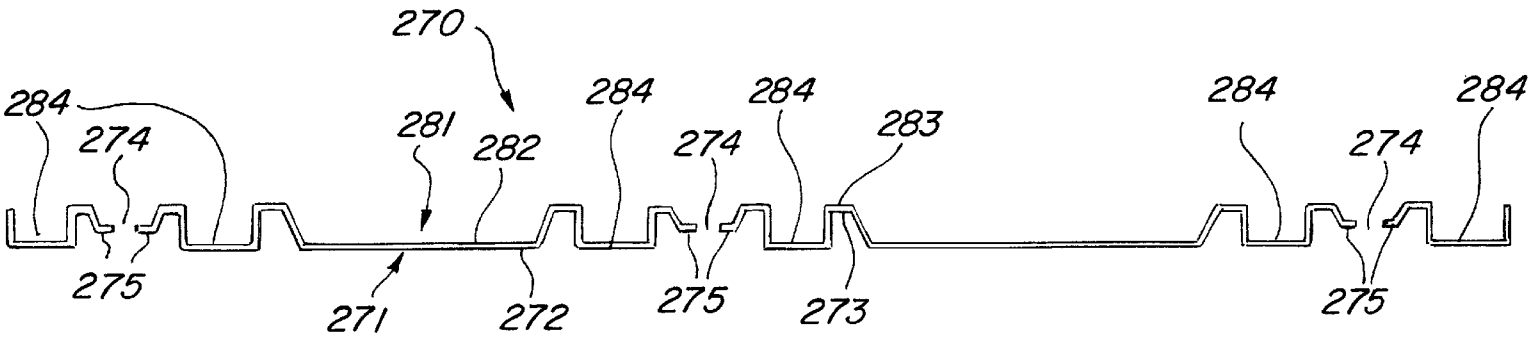
FIG. 27 is a cross-sectional view of the lower deck in FIG. 26 taken along lines 27'—27'.
Figure 28:
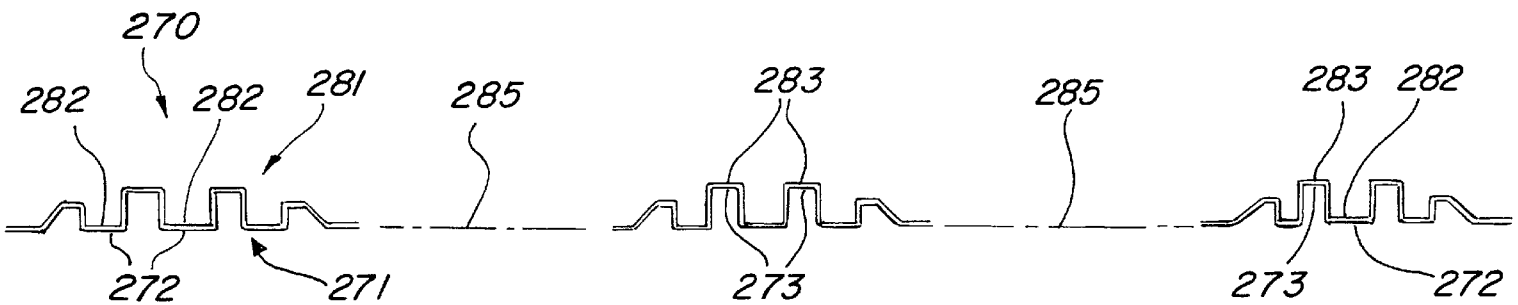
FIG. 28 is a cross-sectional view of the lower deck in FIG. 26 taken along lines 28'—28'.

FIGS. 27 and 28 are cross-sectional views of the lower pallet 270 in FIG. 26 taken along lines 27'—27' and 28'—28', respectively. The pallet jack deck, or cross deck, 270 has an external surface 271 and an internal surface 281 opposite and substantially parallel to the external surface 271. The lower pallet 270 also comprises a plurality of ridges and channels. Since the internal surface 281 is substantially parallel to the external surface 271, each ridge 272 in the external surface 271 corresponds to a channel 282 in the internal surface 281, and each channel 273 in the external surface 271 corresponds to a ridge 283 in the internal surface 281.

In FIG. 26, the lower deck 270 comprises a plurality of apertures 274 arranged to align with the apertures of the upper deck, and a plurality of shoulders 275, wherein a shoulder 275 surrounds each aperture 274.

Figure 21B:
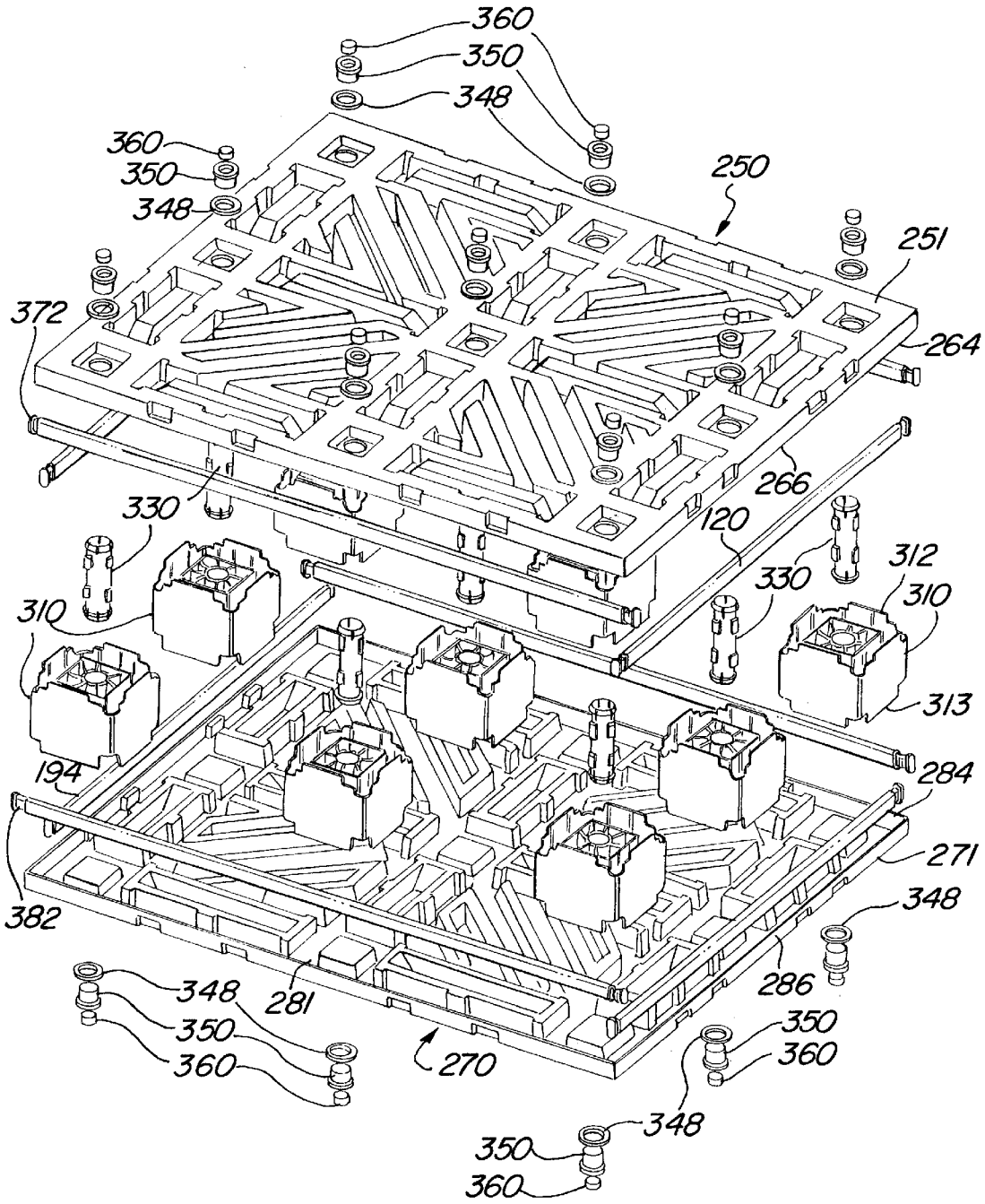
FIG. 21*b* is an exploded view of the modular, non-legged dual deck pallet wherein the lower deck has a substantially similar structure as the structure of the upper deck.

The upper deck 250 and the lower deck 270 are configured in a back-to-back orientation such that the internal surfaces of each deck 261, 281, respectively, face each other as shown in FIGS. 21*a* and 21*b*. Accordingly, the external surfaces 251, 271 of each deck 250, 270 face outwardly away from each other. More specifically, the external surface 271 of the lower deck 270 faces downward while the external surface 251 of the upper deck 250 faces upward. Thus, the external surface 271 of the lower deck 270 is adapted to rest on the ground, on top of another deck, or on top of packages supported by another deck. The external surface 251 of the upper deck 250 is adapted to support or hold packages.

As shown in FIGS. 20, 21*a* and 21*b*, a plurality of columns 310 are disposed between the upper deck 250 and the lower deck 270. In effect, the columns 310 serve to replace the legs 108 of the dual deck embodiment shown in FIG. 5. The internal surfaces 261, 281 of the upper and lower decks 250, 270 each have a plurality of column channels 264, 284 shaped to receive the top and bottom portions 312, 313, respectively, of the column 310. Reinforcement channels 266, 286 are also formed in the internal surfaces 261, 281 of the upper and lower decks 250, 270.

Figure 29A:
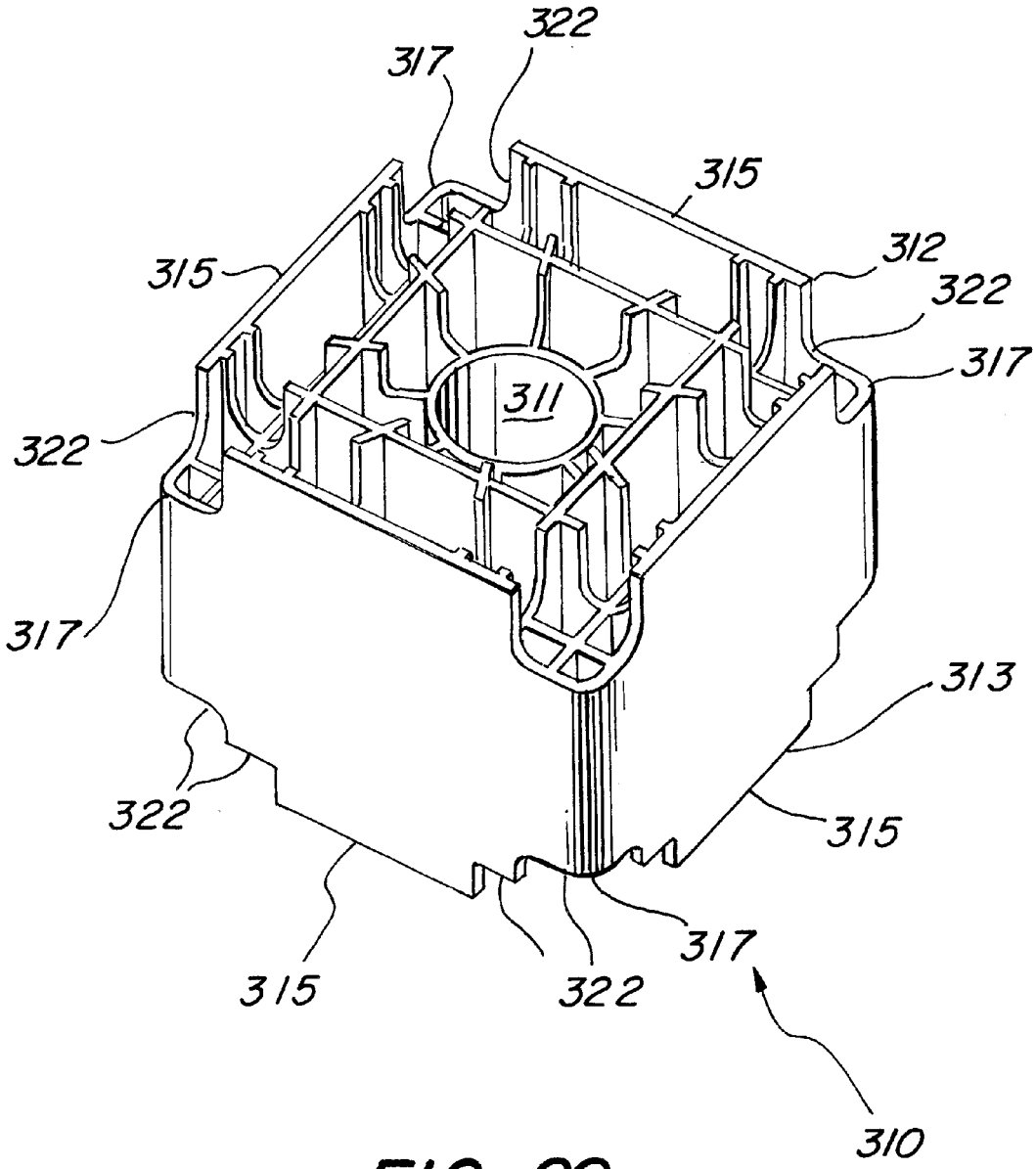
FIG. 29*a* is a perspective view of a column.
Figure 29B:
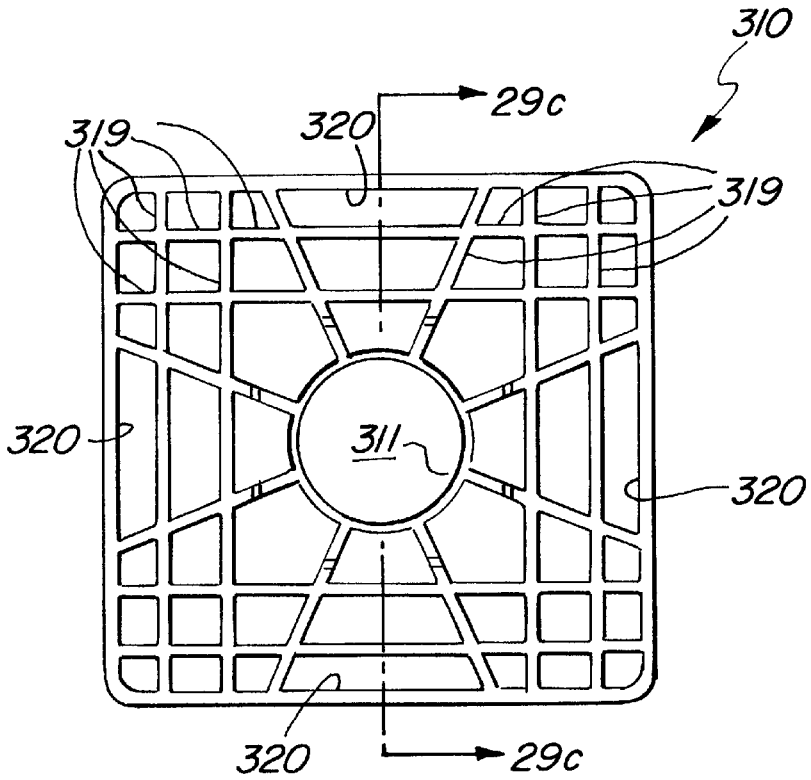
FIG. 29*b* is a top plan view of the column.
Figure 29C:
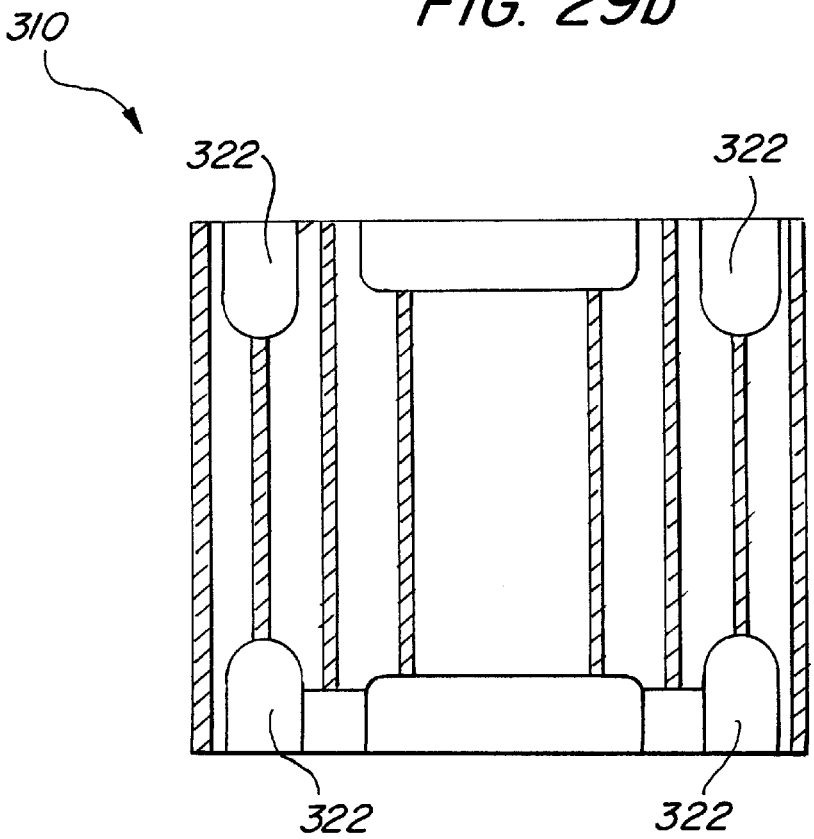
FIG. 29*c* is a cross-sectional view of the column taken along lines 29*c*—29*c* in FIG. 29*b*.

FIG. 29*a* is a perspective view of the column 310. Each column 310 has a central tube 311 extending all the way through from a top portion 312 to a bottom portion 313 of the column 310. The column 310 is shaped as rectangle with an outer wall 315 disposed at right angles to form four corners 317. FIG. 29*b* is a top plan view of the column 310. In FIG. 29*b*, the column 310 comprises a plurality of flanges 319 that either extend between the inner surfaces 320 of the column 310, or extend from the inner surface 320 to the central tube 311. In FIGS. 29*a* and 29*c*, passageways 322 are carved out from the corners 317 of the wall 315 at both the top portion 312 and the bottom portion 313, and from the flanges 319 adjacent to the inner surface 320 at both the top portion 312 and the bottom portion 313. Thus, the passageways 322 not only receive reinforcing members, but provide a tight fit for them. As shown in FIG. 29*c*, the passageways 322, in profile, may have an oval shape to receive an oval-profiled reinforcing member or a combination of an oval shape and a square as shown in the bottom passageways 322 so as to receive either oval-profiled or square-profiled reinforcing members.

Figure 30:
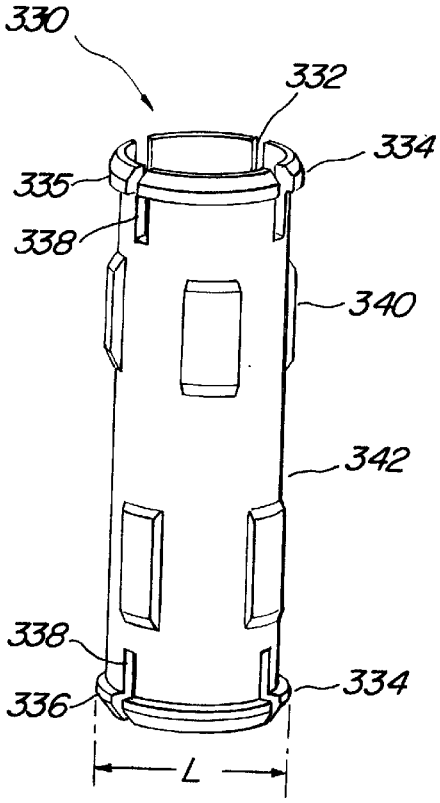
FIG. 30 is a perspective view of a clamping pin.

In FIGS. 20, 21*a* and 21*b*, the pallet 240 further comprises a plurality of clamping pins 330. Each clamping pin 330 is inserted through the tube 311 of the column 310. FIG. 30 is a perspective view of the clamping pin 330. The clamping pin 330 has a hollow core 332. Protruding lips 334 are disposed at both ends 335, 336 of the clamping pin 330. The lips 334 have an outer diameter "L" that is greater than the diameter of the apertures 254, 274 of the upper and lower deck 250, 270. The clamping pin 330 further comprises longitudinal slots 338 disposed at the ends 335, 336 to enable the lips 334 to be compressed centrally so as to allow the lips 334 to be inserted through the apertures 254, 274 of the upper and lower decks 250, 270 as shown in FIGS. 23 and 27. The clamping pin 330 further comprises longitudinal ribs 340 disposed on an outer surface 342. The ribs 340 contact the tube 311 of the column 310 and provide a tighter fit for the clamping pin 330.

Figure 31:
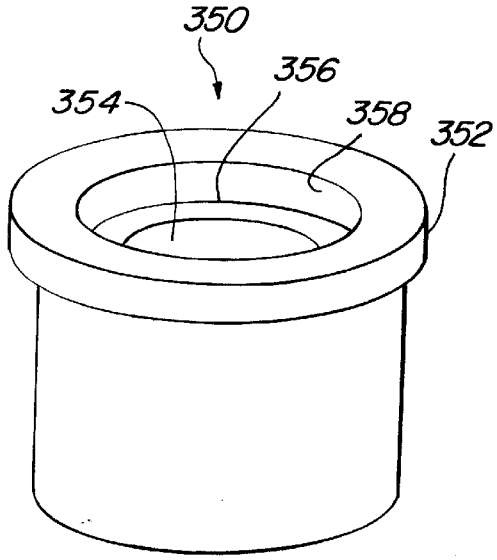
FIG. 31 is a perspective view of a rigid insert.

In FIGS. 20, 21*a* and 21*b*, the pallet 240 further comprises a plurality of rigid bushes, or rigid inserts, 350. A rigid insert 350 is disposed in the hollow core 332 of the clamping pin 330 at both ends 335, 336. Since the ends 335, 336 are flexible due to the longitudinal slots 338, the rigid inserts 350 serve to prevent the lips 334 from compressing centrally, thus keeping the lips 334 tightly fitted against the shoulders 255, 275 surrounding the apertures 254, 274 of the upper deck 250 and the lower deck 270 as shown in FIG. 20. Locking washers 348 may be disposed between the shoulders 255, 275 of the decks 250, 270 and the lips 334 of the clamping pins 330. FIG. 31 is a perspective view of the rigid insert 350. The rigid insert 350 comprises an annular shoulder 352. As shown in FIG. 20, the annular shoulder 352 rests against the lip 334 of the clamping pin 330. The rigid insert 350 has a central recess 354. An annular ledge 356 is disposed along an inner surface 358 of the rigid insert 350.

Figure 32:
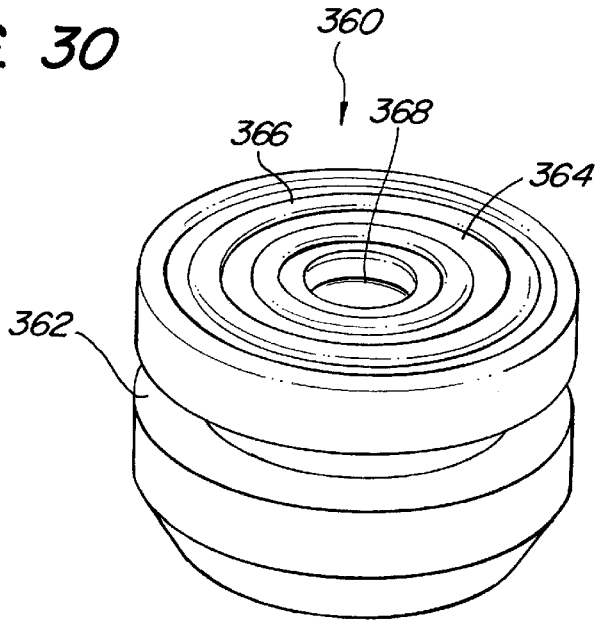
FIG. 32 is a perspective view of an anti-skid plug.

As shown in FIGS. 20, 21*a* and 21*b*, the pallet 240 further comprises a plurality of anti-skid plugs 360. Each plug 360 is disposed in the central recess 354 of the rigid insert 350. FIG. 32 is a perspective view of the plug 360. The plug 360 comprises an annular groove 362 shaped to receive the annular ledge 356 of the rigid insert 350 so as to provide a tight fit. The plug 360 has an anti-skid contact surface 364 comprising concentric ridges 366. Thus, the contact surface 364 is adapted to provide friction against objects placed thereon, or against objects upon which the pallet 240 is resting, such as the ground, another pallet, or merchandise supported by another pallet. The anti-skid plug 360 further comprises a central recess 368 to enable a user to remove the plug 360 from the rigid insert.

Figure 33:
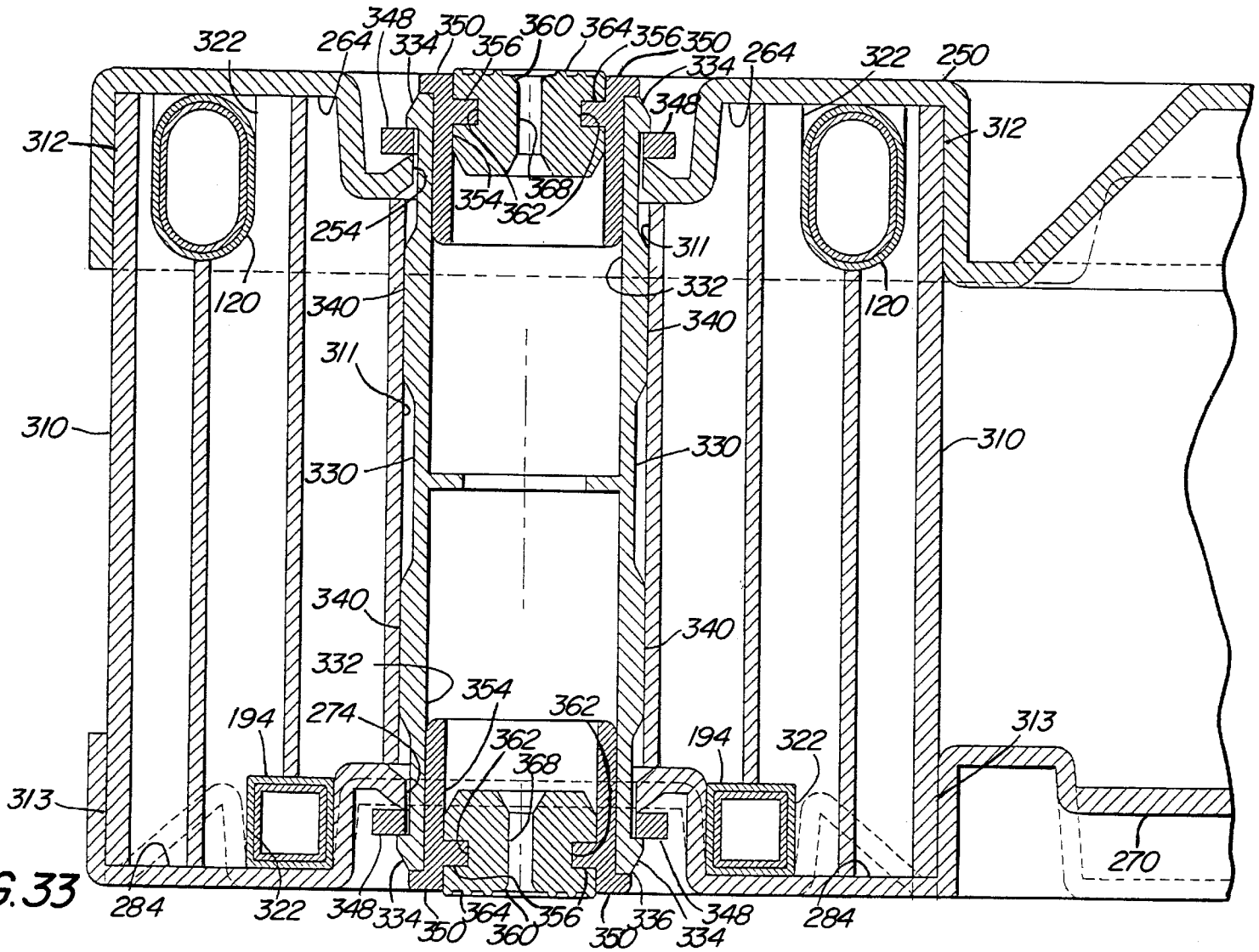
FIG. 33 is a close-up cross-sectional view of the non-legged dual deck pallet taken along lines 33'—33' in FIG. 20.

FIG. 33 is a cross-sectional close-up view of the pallet 240 wherein the lower deck pallet 270 is a cross deck as illustrated in FIG. 26. FIG. 33 illustrates the various components involved in coupling the upper deck 250 to the lower deck 270. The column 310 is received within the column channels 264, 284 of the upper and lower decks 250, 270, respectively. The clamping pin 330 is inserted through the central tube 311 of the column 310. The ends 335, 336 of the clamping pin 330 extend out through the apertures 254, 274 of the upper and lower decks 250, 270. Locking washers 348 are disposed between the lips 334 of the clamping pin 330 and the shoulders 255, 275 of the upper and lower decks 250, 270. The ribs 340 of the clamping pin 330 contact the tube 311 of the column 310 to provide a snug fit. The rigid insert 350 is disposed within the hollow core 332 of the clamping pin 330 at both ends 335, 336 such that the annular shoulder 352 of each rigid insert 350 rests against the ends 335, 336 of the clamping pin 330. The anti-skid plug 360 is disposed in the central recess 354 of each rigid insert 350 such that the annular groove 362 of each plug 360 receives the annular ledge 356 of the rigid insert 350. The plugs 360 are disposed such that the contact surfaces 364 are disposed slightly outward from the remainder of the external surfaces 251, 271 of the upper and lower decks 250, 270 so as to engage objects placed against the pallet 240.

Upper reinforcing members 120 with an oval profile extend through the oval-shaped passageways 322 at the top portion 312 of the column 310 while lower reinforcing members 194 with a rectangular, or square, profile extend through square-shaped passageways 322 at the bottom portion 313 of the column 310. The reinforcing members 120, 194 are thus locked in position without means of escape. As shown in FIG. 21*b*, the reinforcing members 120,194 may include end caps 372, 382 having the same profile. Thus, the ends caps 372 for the upper reinforcing members 120 have an oval shape while the end caps 382 for the lower reinforcing members 194 have a square shape. The end result of this structure is that the upper deck 250 is tightly secured to the lower deck 270, and all the various components are snugly configured without need of additional components. Alternatively, each deck 250, 270 may include a second reinforcing member.

Where the lower pallet 270 has a structure substantially similar to the structure of the upper pallet 250 as shown in FIG. 25, the pallet 240 comprises oval-shaped reinforcing members 120,194 received in both the upper and lower decks 250, 270.

In operation, the pallet in all embodiments described above functions to provide an economical, efficient, and extremely strong pallet formed of thermoplastic material. Reinforcing members can be added the pallet to further increase the strength of the pallet without excessively increasing the weight of the pallet. The pallet is, thus, durable and can withstand long term use. Additional advantages of the pallets described above include the following: (1) the pallets are reversible in some configurations; (2) the weight of material used to manufacture the pallets is less than conventional wooden pallets; (3) the lower deck design of some pallet embodiments ensures even weight distribution; (4) many embodiments of the pallets comprise a single structural body rather than a plurality of parts coupled together, thus presenting a strong unitary pallet, (5) the pallets are fabricated of recyclable materials; (6) the pallets can be provided in a kit form that is easily stored and moved in the disassembled state, and that is readily assembled at a desired location; (7) in the disassembled state the upper and/or lower decks may be easily stored in nested stacks, thus minimizing the volume of space required to store the unused pallets; (8) runners provide extra strength and rigidity to the decks and prevent them from bowing, especially when the pallets are carrying heavy loads or are being lifted by a forklift; (9) runners provide greater stability when the pallet is being placed on an uneven surface; and (10) runners allow pallets carrying malleable packages to be stacked on top of each other without damaging the packages.

When used for storing or moving objects that may be upset by the ridges and channels on the load bearing surface of the pallets, such as relatively small objects, a plastic, ply wood, or metal sheet may be placed on the load bearing surface between the upper deck and the load on the pallet to present a flat surface. In alternate embodiments, the load bearing surface may include ridges, depressions, or other structures designed for securely locating or holding materials on the pallet. For example, the pallet may include one or more raised projections to be received within a hollow core of spooled materials to be stored or moved on the pallet.

Pallets constructed in accordance with this description have been found to support loads ranging from 750 kg to more than 1.5 metric tons dynamic load, and 2 metric tons to more than 6 metric tons static load, depending on the configuration of the pallet and whether reinforcing members are used. The pallets have been observed to have a typical useful life more than 10 times the life of standard wooden pallets.

Although the present invention has been described in terms of the presently preferred embodiments, it is to be understood that such disclosure is not to be interpreted as limiting. Various alterations and modifications will no doubt become apparent to those skilled in the art after reading the above disclosure. It is to be expressly understood that features associated with one embodiment may be excised and substituted in any other embodiment. For instance, though the preferred embodiment of the single deck pallet with runners does not include reinforcing members, it nonetheless could include runners as disclosed in the other embodiments. Accordingly, it is intended that the appended claims be interpreted as covering all alterations and modifications as fall within the true spirit and scope of the invention.

What is claimed is:

1. A pallet comprising:

a single sheet comprising a rigid but formable material, a load bearing surface on a first side of the sheet, and a lifting surface on an opposite second side of the sheet, wherein the lifting surface is substantially parallel to the load bearing surface;

a plurality of depressions in the load bearing surface corresponding to an equal number of legs extending from the lifting surface;

a runner coupled to at least two of the legs, each of the at least two legs comprising a recessed portion and an exposed portion, the runner including a flat bottom runner surface, the runner being disposed in the recessed portions of the at least two legs such that the bottom runner surface is substantially flush with the exposed portions of the at least two legs; and a plurality of top channels and top ridges formed in the load bearing surface wherein each top ridge formed in the load bearing surface corresponds to a bottom channel formed in the lifting surface and each top channel formed in the load bearing surface corresponds to a bottom ridge formed in the lifting surface.

2. The pallet of claim 1 wherein the single sheet has four edges defining a periphery, the pallet further comprising a peripheral channel formed adjacent to the periphery of the sheet.

3. The pallet of claim 1 wherein the rigid but formable material of the sheet comprises a thermoplastic material.

4. The pallet of claim 1 wherein the plurality of depressions comprises nine depressions corresponding to nine legs, the nine depressions and legs being disposed in three rows with each row having three depressions and three corresponding legs.

5. The pallet of claim 4 wherein the runner is coupled to one of the rows of three legs.

6. The pallet of claim 1 wherein the runner has a flat top runner surface.

7. The pallet of claim 1 wherein the runner comprises wood.

8. The pallet of claim 1 wherein the runner comprises a thermoplastic covering.

9. The pallet of claim 1 wherein the runner is removably coupled to the at least two legs.

10. The pallet of claim 9 further the runner is removably coupled to the at least two legs with a locking pin.

11. A method for stacking decks when the decks are not bearing a load, the method comprising:

providing a first deck having a first top surface and a first bottom surface substantially parallel and opposite to the first top surface;

forming a first plurality of channels and ridges in the first deck to form a plurality of channels and ridges in the first top surface and a corresponding plurality of channels and ridges in the first bottom surface wherein each ridge in the first top surface corresponds to a channel in the first bottom surface and each channel in the first top surface corresponds to a ridge in the first bottom surface;

forming depressions in the first top surface corresponding to an equal number of legs extending from the first bottom surface;

providing each leg extending from the first bottom surface with a recessed portion and an exposed portion;

disposing a first runner with a first flat bottom runner surface in the recessed portions of at least two legs extending from the first bottom surface such that the first flat bottom runner surface is substantially flush with the exposed portions of the at least two legs;

providing a second deck with a substantially similar structure as a structure of the first deck, wherein the second deck has a second top surface and a second bottom surface substantially parallel and opposite to the second top surface;

forming a second plurality of channels and ridges in the second deck to form a plurality of channels and ridges in the second top surface and a corresponding plurality of channels and ridges in the second bottom surface wherein each ridge in the second top surface corresponds to a channel in the second bottom surface and each channel in the second top surface corresponds to a ridge in the second bottom surface;

forming depressions in the second top surface corresponding to an equal number of legs extending from the second bottom surface;

providing each leg extending from the second bottom surface with a recessed portion and an exposed portion; and disposing a second runner with a second flat bottom runner surface in the recessed portions of at least two legs extending from the second bottom surface such that the second flat bottom runner surface is substantially flush with the exposed portions of the at least two legs.

12. The method in claim 11 further comprising:

removing the first runner from the at least two legs extending from the first bottom surface; and removing the second runner from the at least two legs extending from the second bottom surface.

13. The method in claim 12 further comprising nesting each leg extending from the first bottom surface with a corresponding depression on the second top surface.

14. The method in claim 12 further comprising: stacking the first deck on top of the second deck wherein a ridge in the first bottom surface nests on top of a channel in the second top surface and a channel in the first bottom surface nests on top of the ridge in the second top surface.

* * * * *